US005281756A

United States Patent [19]

Kawashima

[11] Patent Number: 5,281,756

[45] Date of Patent: Jan. 25, 1994

[54] ELECTRONIC MUSICAL INSTRUMENT CAPABLE OF ASSIGNING DESIRED TONES TO A PERFORMANCE OPERATOR

[75] Inventor: Susumu Kawashima, Hamamatsu, Japan

[73] Assignee: Yamaha Corporation, Hamamatsu, Japan

[21] Appl. No.: 785,544

[22] Filed: Oct. 31, 1991

[30] Foreign Application Priority Data

Nov. 1, 1990 [JP] Japan ..... 2-296600
Nov. 1, 1990 [JP] Japan ..... 2-296601
Jul. 9, 1991 [JP] Japan ..... 3-194911

[51] Int. Cl.[5] ..... G10H 1/18
[52] U.S. Cl. ..... 84/615; 84/653
[58] Field of Search ..... 84/615-620, 84/622-625, 653-665, 678-690, 692-700, 735, 736, 742

[56] References Cited

U.S. PATENT DOCUMENTS 4,350,068 9/1982 Suzuki et al. ..... 84/615
4,773,294 9/1988 Iizuka et al. .
4,881,440 11/1989 Kakizaki ..... 84/609
4,953,438 9/1990 Shibukawa ..... 84/609
4,957,552 9/1990 Iwase ..... 84/615 X

*Primary Examiner*—Stanley J. Witkowski

*Attorney, Agent, or Firm*—Spensley Horn Jubas & Lubitz

[57] ABSTRACT

Desired tones are selected by a key depression operation or the like operation of an electronic musical instrument and these selected tones are assigned to one of pad type performance operators. When this performance operator has been operated, the tones which have been assigned thereto are sounded simultaneously or sequentially. In assigning desired tones to the performance operator, setting operators for setting tone volume, effects etc. may be set at desired set state and set information representing this set state may be stored. In this case, tone signals corresponding to tones which have been assigned to the performance operator are generated and the stored set information is read out and a control such as a tone control and effect imparting control is performed in accordance with the set information. In assigning a desired tone to the performance operator, assigning of a tone which has been selected by a key depression operation or the like to the performance operator may be realized when the performance operator has been turned from an on state to an off state. By this arrangement, selective change of a tone to be assigned can be made freely even after turning on of the performance operator if it is before the performance operator is turned off.

17 Claims, 14 Drawing Sheets

ELECTRONIC MUSICAL INSTRUMENT CAPABLE OF ASSIGNING DESIRED TONES TO A PERFORMANCE OPERATOR

BACKGROUND OF THE INVENTION

This invention relates to an electric musical instrument capable of assigning desired plural tones to a performance operator such as a pad type operator and generating the plural tones by a single operation of the performance operator. This invention relates also to an electronic musical instrument capable of storing set states of various setting operators for setting tone volume, effects and the like and reproducing the set states by an operation of the performance operator. This invention relates also to an electronic musical instrument capable of performing an assigning operation in a simple manner in assigning desired tones to a performance operator.

An electronic musical instrument capable of assigning desired tones such as rhythm sounds to a performance operator is disclosed in Japanese Patent Application Laid-open No. Sho 61-282896. In this electronic musical instrument, one rhythm sound source can be selected from among plural rhythm sound sources and assigned to a performance operator.

In the above described prior art instrument, only one tone can be assigned to one performance operator and, therefore, the performance operator can be utilized only for a simple percussion sound performance operation with resulting limitation to its performance ability.

A function of generating plural tones by operating a single key in a keyboard is known as the single finger function in the automatic bass chord performance or the like function. In this case, however, a chord corresponding to a depressed key is fixed to one for which the depressed key is used as its root tone and a free assignment of a chord to the key cannot be made. Accordingly, a player must accurately find out a key on the basis of which a desired chord can be produced. Moreover, such function is normally performed in combination with progress of the automatic rhythm performance and, therefore, sounding of a chord at a timing desired by the player cannot be made.

In the prior art electronic musical instrument, it is only a tone source signal of a rhythm sound that can be assigned to a pad type performance operator and set states of setting operators for setting tone volume and effects cannot be assigned to a pad. These setting operators, therefore, must be set at desired set states each time a performance is made which imposes a burden of performing a very troublesome operation to the player.

Further, in the prior art electronic musical instrument, in a case where a desired rhythm sound is assigned to a performance operator, the desired rhythm sound is first selected and, thereafter, the performance operator to which the player desires to assign the rhythm sound is turned on and assignment of the rhythm sound is made in response to this turning on of the performance operator. Therefore, a tone to be assigned is determined definitely when the performance operator has been turned on and, when a wrong tone has been designated for assignment to the performance operator, designation of a tone to be assigned must be made again and the performance operator, must be operated again. Accordingly, the operation for assignment is troublesome and a very careful operation for assignment is required.

Further, in the prior art electronic musical instrument, when the player desires to change an assigned tone by listening to a tone which has already been assigned to the performance operator and confirming the assigned tone, he must first cause the tone to be sounded by turning on the performance operator and then designate a desired tone to be assigned and turn on the performance operator again. Thus, he must make an operation for generating the already assigned tone and an operation for assigning a new tone separately, which is apparently very troublesome.

SUMMARY OF THE INVENTION

It is, therefore, an object of the invention to provide an electronic musical instrument capable of assigning desired plural tones to a performance operator and generating the plural tones by a single operation of the performance operator.

It is a second object of the invention to provide an electronic musical instrument capable of switching between simultaneous generating of plural tones and sequential generation of plural tones by a single operation of the performance operator.

It is a third object of the invention to provide an electronic musical instrument capable of assigning not only a tone source signal but also set states of setting operators for setting tone volume, various effects etc. to a performance operator and reproducing not only the assigned tones but also the set states of these setting operators when the performance operator has been operated.

It is a fourth object of the invention to provide an electronic musical instrument capable of performing, when a desired tone is assigned to a performance operator, operations for reassigning a tone and confirming an already assigned tone in a simple manner.

For achieving the first object of the invention, the electronic musical instrument according to the invention comprises a pad type performance operator, assigning means for assigning desired plural tones in correspondence to the performance operator, said assigning means being capable of changing the plural tones to be assigned to the performance operator, and tone signal generation means for generating tone signals corresponding to the plural tones assigned to said performance operator when said performance operator is operated.

Desired plural tones are assigned to one performance operator by the assigning means. Change of this assignment can be made as desired. The plural tones which is assigned to the performance operator are generated by the tone signal generation means when the performance operator is operated. Therefore, by assigning desired plural tones to the performance operator in accordance with a music performed at each performance occasion, the desired plural tones can be generated in a simple manner by a single operation of the performance operator.

In one aspect of the invention, said assigning means assigns the plural tones to be generated simultaneously to said performance operator, and said tone signal generation means generates the plural tones which are assigned to said performance operator simultaneously as said performance operator is operated. By this arrangement, simultaneous performance of plural tones such as a performance of a chord can be realized in a simple manner.

In another aspect of the invention, said assigning means assigns plural tones which are to be generated sequentially to said performance operator, and said tone signal generation means sequentially generates the plural tones which are assigned to said performance operator when said performance operator is operated. By this arrangement, performance of sequential tones can be achieved in a simple manner.

For achieving the second object of the invention, the electronic musical instrument according to the invention comprises a performance operator, mode selection means for selecting one of a first mode in which plural tones are generated simultaneously in correspondence to operation said performance operator and a second mode in which plural tones are generated sequentially in correspondence to operation of said performance operator, assigning means for assigning desired plural tones in correspondence to said performance operator in accordance with the mode which is selected by said mode selection means, said assigning means being capable of changing desired plural tones to be assigned to the performance operator, and tone signal generation means for generating tone signals corresponding to the desired plural tones which are assigned to performance operator in accordance with the selected mode when said performance operator is operated.

By the provision of the mode selection means capable of selecting one of the first mode in which plural tones can be generated simultaneously by operation of the performance operator and the second mode in which the plural tones can be generated sequentially by operation of the performance operator, the simultaneous performance of plural tones such as a chord can be made in a simple manner by a single operation of the performance operator when a desired assignment of tones to the performance operator has been made in accordance with the first mode and the sequential performance of the plural tones can also be made in a simple manner by a single operation of the performance operator when a desired assignment has been made in accordance with the second mode. By selection of performances of these two different modes, the performance ability of the electronic musical instrument is greatly improved. A plurality of the performance operators may be provided and assignments in different modes among the plural performance operators can coexist. By coexistence of performances of different modes, the performance ability is improved to an even greater degree.

For achieving the third object of the invention, the electronic musical instrument according to the invention comprises a performance operator, assigning means for assigning a desired tone in correspondence to said performance operator, setting operator means including a setting operator for setting data for controlling a tone, memory means for storing set data set by said setting operator of said setting operator means in correspondence to a tone assigned to said performance operator, and tone signal generation means for generating a tone signal of the tone corresponding to said performance operator and reading out the set data stored in said memory means as to perform a control corresponding to the set data when said performance operator is operated.

Set data set by the setting operator is stored in the memory means in correspondence to the tone assigned to the performance operator. By operation of the performance operator, a tone signal corresponding to the tone which is assigned to the performance operator is generated and the set data stored in the memory means is read out and a control corresponding to the set data is performed. By this arrangement, when a tone is assigned to the performance operator, desired set data set by the setting operator can be assigned in correspondence to the performance operator. When, therefore, the assigned tone is reproduced by operation of the performance operator, the desired set data set by the setting operator can be reproduced at once so that a control of a reproduced tone and various effects imparted to the reproduced tone can be reproduced by the desired set data. The operation of the electronic musical instrument thereby is facilitated and tones can be reproduced with more accuracy whereby the performance ability is improved. Further, by providing a plurality of the performance operators, the performance ability is further improved since a different set state can be assigned for each of the performance operators. When, for example, the plural performance operators are simultaneously operated to generate the assigned tones, the tone control can be made in different set states for each of the tones corresponding to the respective performance operators, so that an entirely novel performance effect can be produced.

For achieving the third object of the invention, in another aspect of the invention, the electronic musical instrument comprises a performance operator, setting operator means including a setting operator for setting data for controlling a tone, assigning means for assigning desired plural tones one by one to said performance operator in a desired tone generation order, memory means for storing information representing a set state of said setting operator of said setting operator means together with timewise change of the set state in correspondence to assignment of a tone to said performance operator by said assigning means, and tone signal generation means for sequentially generating tone signals corresponding to the plural tones which are assigned to said performance operator and reproducing the change in the set state timewise in accordance with storage information in said memory means to perform a control of the tone signals corresponding to reproduced set state when said performance operator is operated.

Desired plural tones are assigned to the performance operator in a desired tone generation order and, in correspondence to this assignment, information representing a set state of the setting operator of the setting operator means is stored together with timewise change of the set state. When this performance operator is operated, the plural tones which are assigned to the performance operator are sequentially generated and the change of the set state is timewise reproduced on the basis of the storage in the memory means to perform a tone control in accordance with the reproduced set state. Performance of sequential tones can thereby be made in a simple manner and, moreover, set states for various tone controls can be automatically changed sequentially as time elapses, so that an entirely novel performance effect can be obtained and the operation is facilitated.

For achieving the fourth object of the invention, the electronic musical instrument according to the invention comprises a performance operator, assigned tone designation means for designating a tone to be assigned to said performance operator, assignment control means for performing a control for assigning the tone which is designated by said assigned tone designation means to said performance operator when said performance operator is turned from an on state to an off state, and tone signal generation means for generating a tone signal corresponding to the tone which is assigned to said performance operator when said performance operator is turned on.

When a desired tone is assigned to the performance operator, the performance operator is first turned on and a desired tone is designated by the assigned tone designation means. The assignment control means assigns the tone which is designated by the assigned tone designation means to the performance operator when the performance operator has turned from an on state to an off state. Since the assignment is determined definitely when the performance operator has turned from an on state to an off state, change of the designated tone can be made freely by the assigned tone designation means even after turning on of the performance operator if it is before turning off of the performance operator. When, therefore, a wrong tone is designated for assignment, designation of the assigned tone has only to be made again and the performance operator need not be turned on again. Thus, the assignment operation is facilitated.

When the performance operator is turned on, the contents of assigned tone have not been changed yet and, accordingly, the already assigned tone can be generated in response to the turning on of the performance operator. The player can therefore listen to this already assigned tone and confirm it and thereafter designate a desired tone to be assigned which is newly assigned when the performance operator is subsequently turned off. Therefore, the operation for generating the already assigned tone and the operation for assigning a new tone can be made at once by a single on-off operation of the performance operator whereby the operations are facilitated.

In the embodiment to be described below, an assignment determining processing corresponding to the turning off of the performance operator is carried out in "plural tones assignment mode". In this "plural tones assignment mode", plural tones which can be generated simultaneously are assigned. The invention is of course not limited to this but it is applicable to a case where only one tone is assigned to the performance operator.

Preferred embodiments of the invention will now be described with reference to the accompanying drawings.

BRIEF DESCRIPTION OF THE DRAWINGS

In the accompanying drawings.

DESCRIPTION OF PREFERRED EMBODIMENTS

Figure 1:
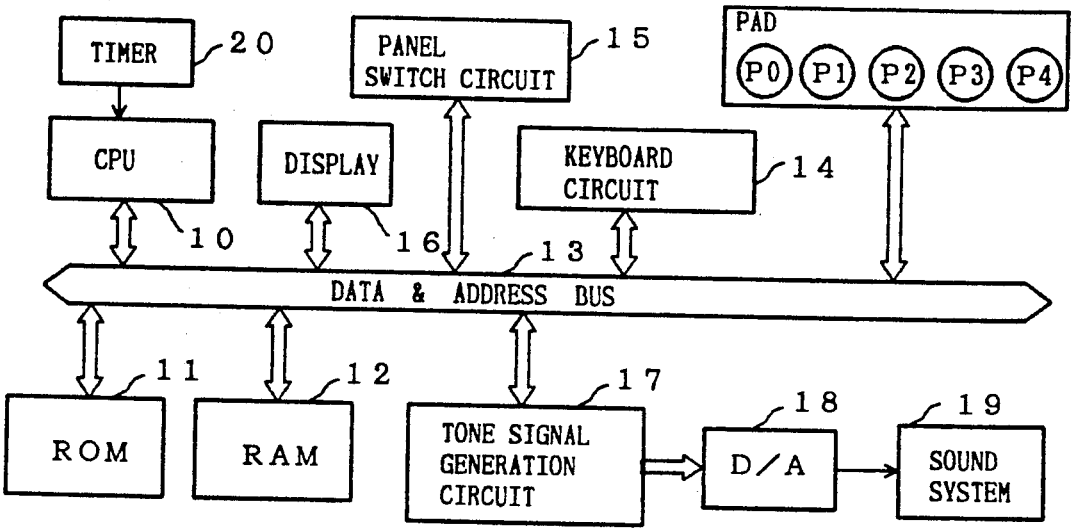
FIG. 1 is a block diagram showing a hardware structure of an embodiment of the invention.

FIG. 1 is a block diagram showing a hardware structure of en embodiment of the electronic musical instrument according to the invention. In this embodiment, various processings are executed under the control of a microcomputer including a central processing unit (CPU) 10, a data and program ROM 11 and a data and working RAM 12. Various circuits including a keyboard circuit 14 and panel switch circuit 15 are connected to the microcomputer through a data and address bus 13.

The keyboard circuit 14 is provided in correspondence to a keyboard having keys for designating tone pitches of tones to be generated and includes key switches corresponding to the respective keys of the keyboard.

The panel switch circuit 15 includes a switch group corresponding to various operators for selecting, setting and controlling tone Solo ne volume, tone pitch, effects etc. A display 16 consisting of LEDs is provided in correspondence to some switches of the panel switch circuit 15 so as to display on-off state of functions corresponding to these switches.

As performance operators, plural pads (e.g., five as in the present embodiment) P0–P4 are provided. Sensors are provided for these pads P0–P4 to detect that the pads have been operated manually by the player or otherwise operated and thereupon supply on-off information of the pads to the bus 13. These pads P0–P4 should preferably be disposed at a location which is easy to access by the player. For example, the pads P0–P4 should preferably be located in the vicinity of the keyboard or on the front panel. Alternatively, the pads P0–P4 may be separated from the main body of the electronic musical instrument and placed as desired by the player at a location easy to access by the player.

To each of the pads P0–P4 can be assigned plural tones. This assignment processing is performed under the control of the CPU 10 on the basis of operation of these pads and switches of the panel switch circuit 15. This assignment processing will be hereinafter referred to as "pad assigning processing".

A tone signal generation circuit 17 can generate different tone signals in plural tone generation channels (e.g., 16 channels). A processing for assigning a tone to each tone signal generation channel which is known as the key assigning processing is performed under the control of CPU 10. Information representing the tones assigned to the respective tone signal generation channels is supplied to the tone signal generation circuit 17 through the bus 13 and the tone signal generation circuit 17, responsive to this information, generates a tone signal in each tone signal generation channel. As is known, the tone signal generation channels in the tone signal generation circuit 17 may be formed on a time shared basis by utilizing a common hardware circuit in time division by the respective channels or may be formed by arranging separate hardware circuits in parallel.

As a tone signal generation system employed in the tone signal generation circuit 17, any known system may be used. Such known systems include, for example, a memory reading system according to which tone waveform sample value data stored in a waveform memory is sequentially read out in response to address data which changes in accordance with the tone pitch of a tone to be generated, an FM system according to which tone waveform sample value data is obtained by implementing a predetermined frequency modulation operation using the address data as phase angle parameter data, and an AM system according to which tone waveform sample data is obtained by implementing a predetermined amplitude modulation operation by using the address data as phase angle parameter data. In the case of using the memory reading system, a tone waveform stored in the waveform memory may be a waveform of one cycle only but storing of a waveform of plural cycles is preferable for improving the tone quality of a generated tone. The systems storing and reading out a waveform of plural cycles include, for example, the system disclosed in British Patent No. 1,572,525 in which a full waveform from the start of sounding of a tone to the end thereof and reading it out once, the system disclosed in Japanese Patent Application Laid-open No. Sho 58-142396 in which an attack waveform of plural cycles and a sustain waveform of one or more cycles are stored and the attack waveform is read out once and thereafter the sustain waveform is repeatedly read out, and the system disclosed in U.S. Pat. No. 4,633,749 in which dispersedly sampled waveforms are stored and a waveform to be read out is designated by sequentially changing it and the designated waveform is repeatedly read out.

The tone signal generation circuit 17 may include not only the tone signal generation channels generating scale tones but also various devices for generating rhythm sound sources and performing the automatic performance functions.

Digital tone signals generated by the tone signal generation circuit 17 are converted to analog signals by a digital-to-analog converter 18 and supplied to a sound system 19 for sounding of tones.

A timer 20 is provided for generating a clock pulse of a predetermined period and this timer clock pulse is applied to the CPU 10 and functions as a timer interrupt signal as will be described later.

In the present embodiment, a tone generation mode corresponding to operation of a pad (hereinafter referred to as "pad mode") includes a simultaneous tone generation mode and a sequential tone generation mode. The first mode, i.e., "simultaneous tone generation mode", is a mode in which plural tones are simultaneously generated in response to operation of one pad. The second mode, i.e., "sequential tone generation mode", is a mode in which plural tones are sequentially generated in response to operation of one pad. For enabling selection of the pad mode, some form of a mode selector may be provided.

In the above described pad assigning processing, the selection as to which of the first and second modes is used ( namely mode selection) is made with respect to a desired one of the pads P0–P4 and an assigning operation according to the selected mode is performed. In this case, tone generation interval in the "sequential tone generation mode" can be so determined that it can be set as desired when an assignment is to be made. For example, by selecting or designating sequentially generated tones at a desired time interval, time interval information may be stored together with information of the selected tones.

For assigning desired plural tones to a desired pad, some form of a selector for selecting tones to be assigned may be provided. By way of example, selection of desired tones to be assigned to the pad may be made by depression of a key in the keyboard so that plural scale tones can be assigned to the pad.

A proper memory device may be provided for storing information of tones which have been assigned to each pad in accordance with selection by the selector. As this memory device, a suitable area (hereinafter refereed to as "pad memory") in the data and working RAM 12 may be used.

Figure 2A:
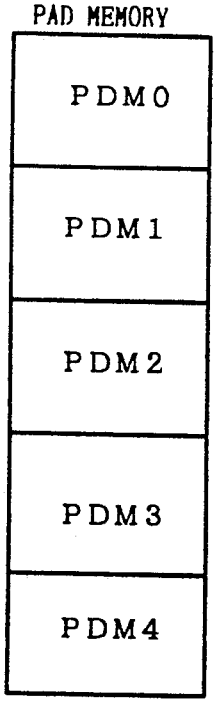
FIGS. 2*a*, 2*b* and 2*c* comprise an example of a memory format of a pad memory in a data and working RAM of FIG. 1.
Figure 2B:
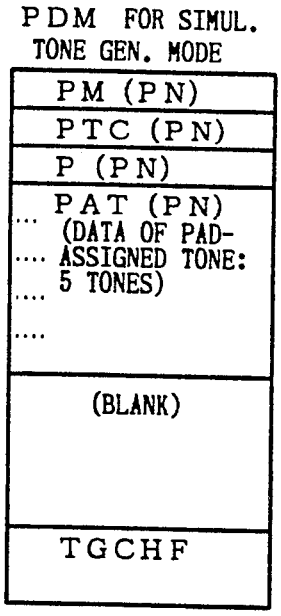
Figure 2C:
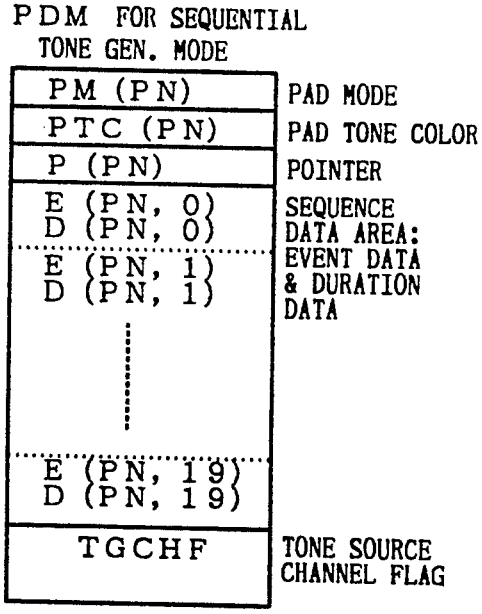

FIGS. 2*a*, 2*b* and 2*c* comprise an example of a format of the pad memory in the data and working RAM 12. For the pads P0–P4, areas of pad memories PDM0–PDM4 are provided (see FIG. 2*a*). Memory format of each of the pad memories PDM0–PDM4 differs depending upon the pad mode which is currently selected for each pad. FIG. 2*b* shows an example of memory format in one pad memory PDM in the case of the simultaneous tone generation mode. FIG. 2*c* shows an example of memory format in one pad memory PDM in the case of the sequential tone generation mode.

Memory data in the simultaneous tone generation mode will now be described with reference to FIG. 2*b*.

PM (PN): Pad mode data: PN represents a pad number identifying a pad (one of the pads P0–P4) corresponding to this pad memory PDM. This data indicates the pad mode which is currently selected (assigned) for the pad corresponding to this pad number. When the pad mode is the simultaneous tone generation mode, the data is "0" whereas when the pad mode is the sequential tone generation mode, the data is "1".

PTC(PN): Pad tone color data: This is data indicating the tone color which is currently assigned to the pad corresponding to the pad number PN. This data consists of code data representing a tone color. Therefore, a different tone color can be assigned to each pad.

P (PN): Pointer: This data is not used in the simultaneous tone generation mode and will be described later.

PAT (PN): Data of Pad assigned tone data: This is data of plural tones which have been assigned to the pad corresponding to the pad number PN by the pad assigning processing. An area of 1 byte is used for one tone. In this embodiment, 5 tones at a maximum can be generated simultaneously and, therefore, 5 bytes are used for storage of the data of the tones assigned to this pad. One byte data constituting data for one tone consists of the key code of several bits representing the tone pitch (i.e., key) of the assigned tone and one bit flag representing that this tone is assigned.

TGCHF: Tone source channel flag: This is a flag indicating the tone signal generation channel to which the tone indicated by the assigned tone data has been assigned. In the pad assigning processing, the tone signal generation channel in which the assigned tone is generated is not designated. The assignment of the tone to the tone signal generation channel is made by the key assigning processing. This tone source channel flag stores the channel to which the tone has been assigned by the key assigning processing. The tone source channel flag consists of 2 bytes=16 bits. One bit of the flag corresponds to one channel and a signal "1" rises at a bit corresponding to the channel to which the pad assigned tone has been assigned.

Referring to FIG. 2*c*, memory data in the sequential tone generation mode will now be described.

PM (PN): Pad mode data: The same as above.

PTC (PN): Pad tone color data: The same as above.

P (PN): Pointer: This is a pointer designating an event order to be described later for performing a control of sequentially generating the sequential tones.

Sequence data area: This is an area in which data of the sequential tones which have been assigned to the pad corresponding to the pad number PN by the pad assigning processing is stored sequentially (in the order of tone generation timing). An area of 2 bytes is used for one event and the sequence data area has a total memory area of 20 events=40 bytes. The 2 byte data for one event consists of event data E (PN, p) and duration data D (PN, p). p (=0, 1, 2, . . . , 19) represents the event order which is designated by the pointer P (PN). The event data E (PN, p) consists of event flag of one bit and a key code of plural bits representing the tone pitch (key) of the assigned tone concerning the event. The event flag is a signal "1" during the key-on event and is a signal "0" during the key-off event. The duration data D (PN, p) is data representing time interval between the current event and next event. At the end of the sequence, a predetermined end mark code is stored.

TGCHF: Tone source channel flag: The same as above.

An example of processings executed by the microcomputer will now be described with reference to the flow charts of FIGS. 3 to 12.

Figure 3:
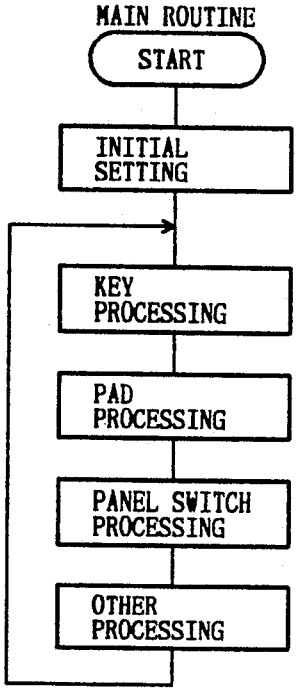
FIG. 3 is a flow chart showing an example of a main routine executed by a microcomputer of this embodiment.
Figure 5:
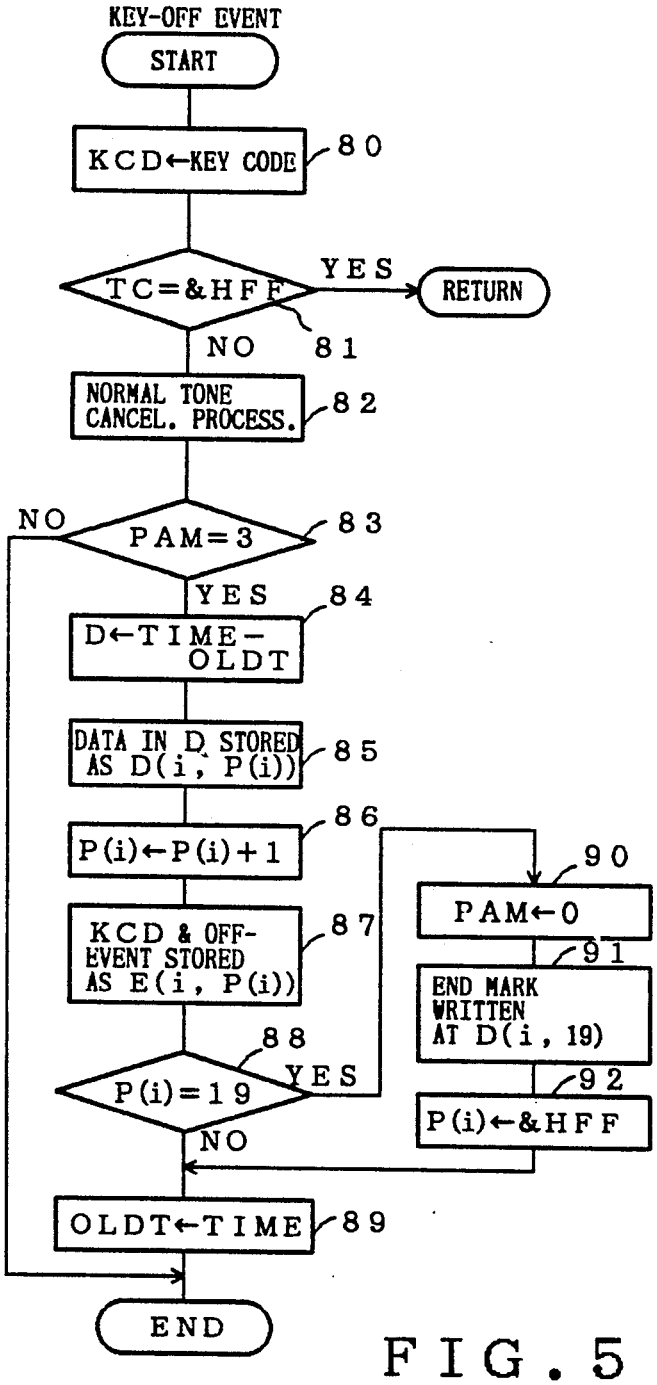
FIG. 5 is a flow chart showing an example of a key-off event processing executed in the key processing of FIG. 4.
Figure 4:
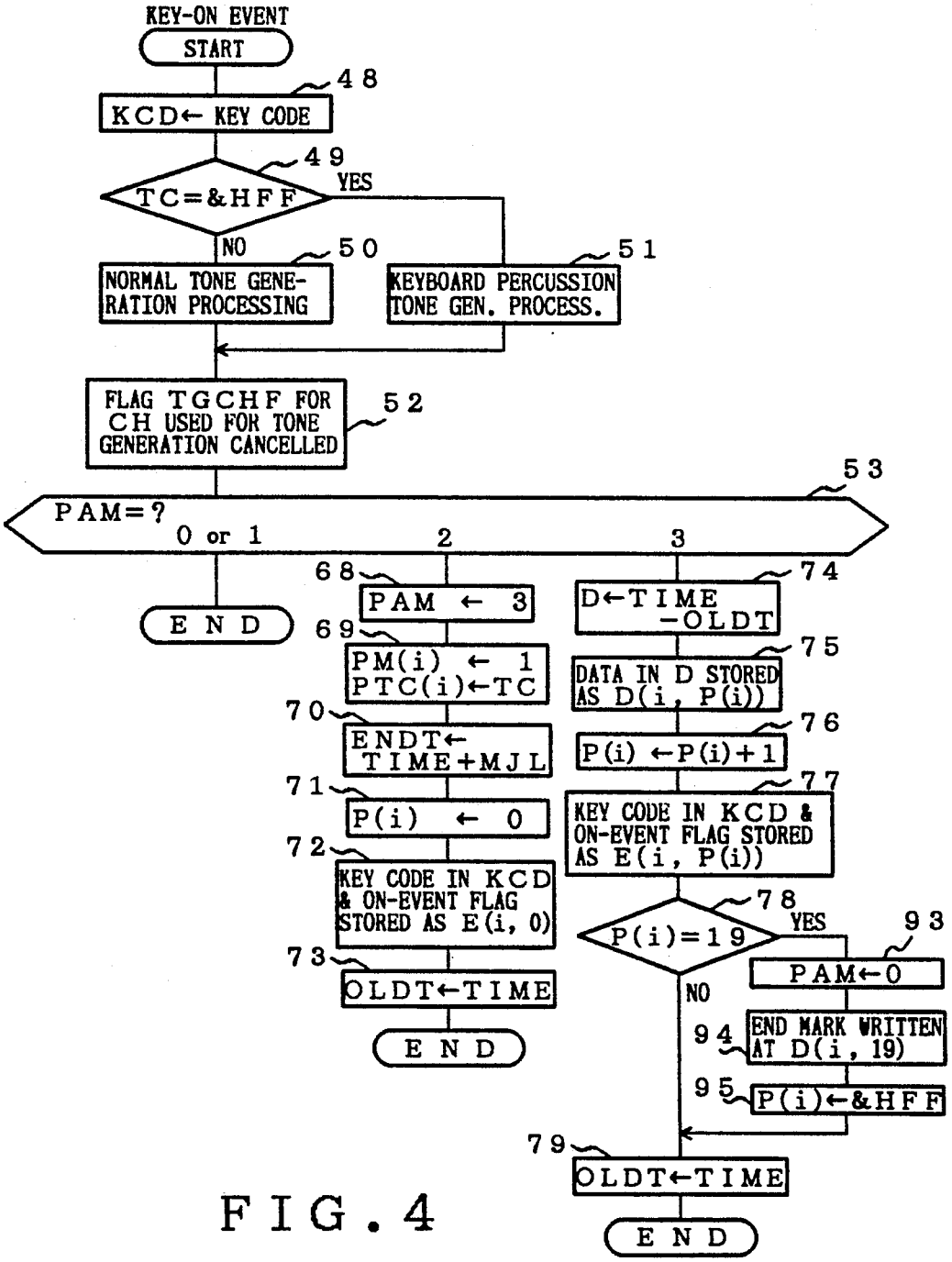
FIG. 4 is a flow chart showing an example of a key-on event processing executed in the key processing of FIG. 3.
Figure 6:
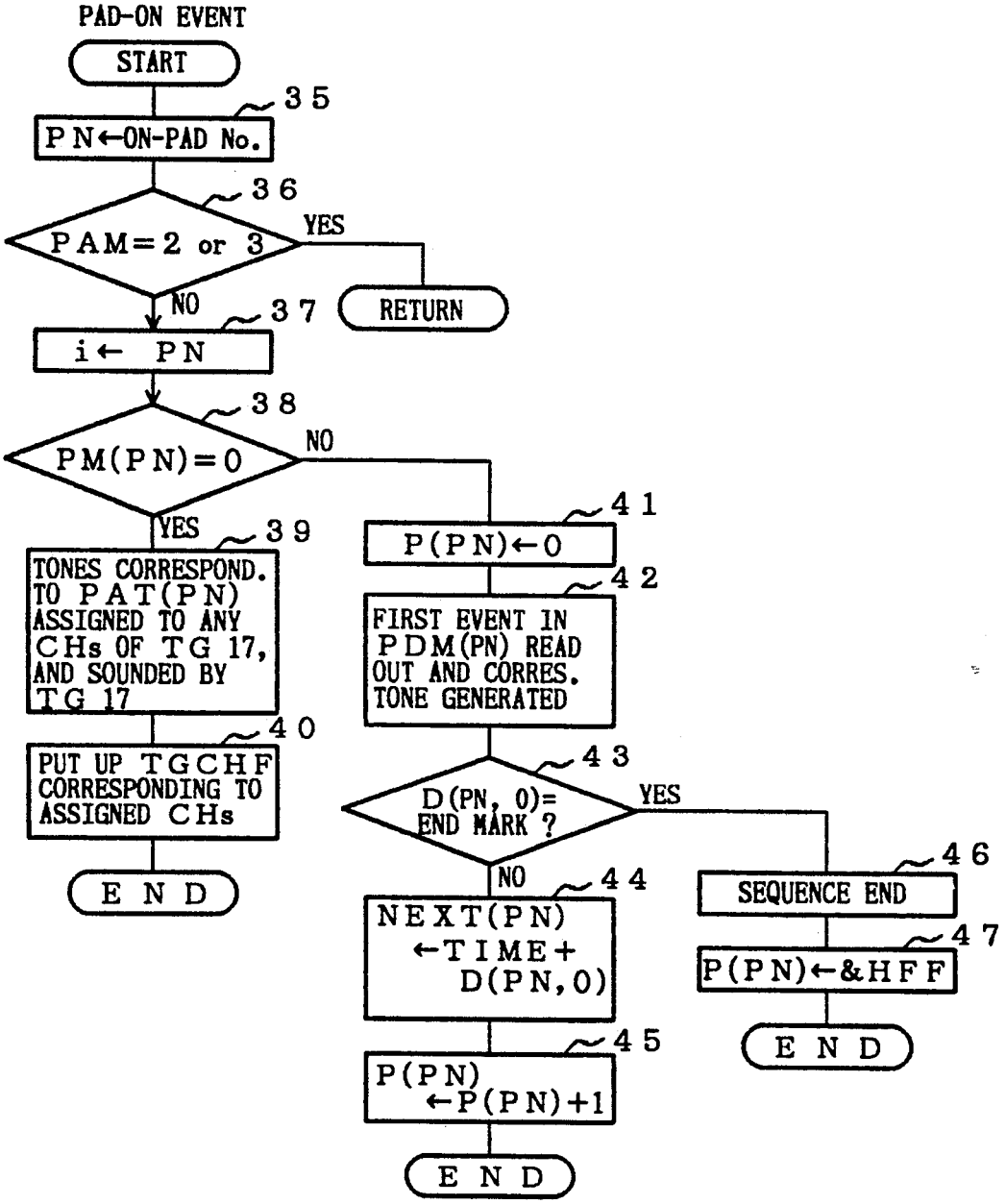
FIG. 6 is a flow chart showing an example of a pad-on event processing executed in the pad processing of FIG. 3.
Figure 7:
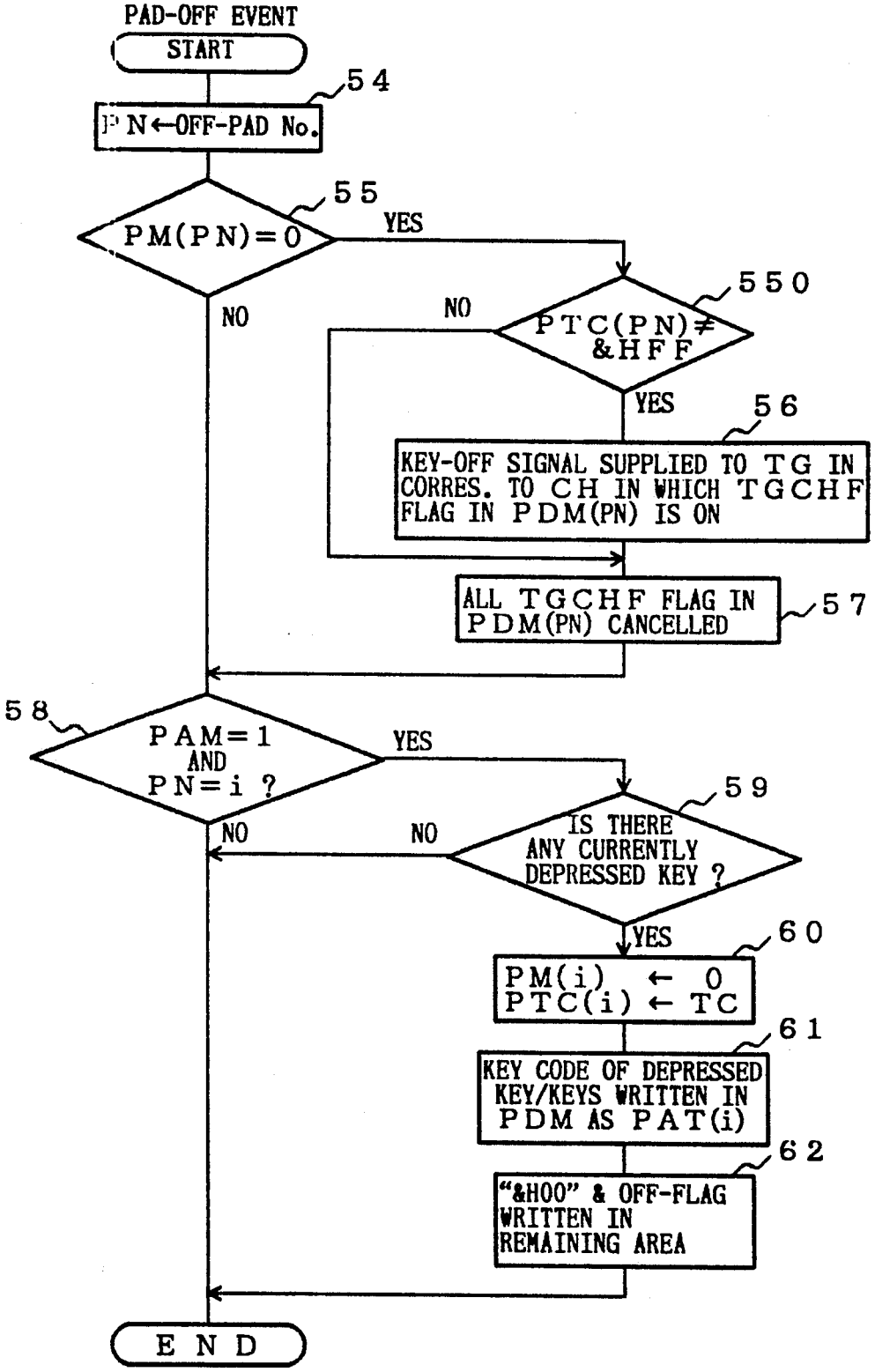
FIG. 7 is a flow chart showing an example of a pad-off event processing executed in the pad processing of FIG. 3.
Figure 8:
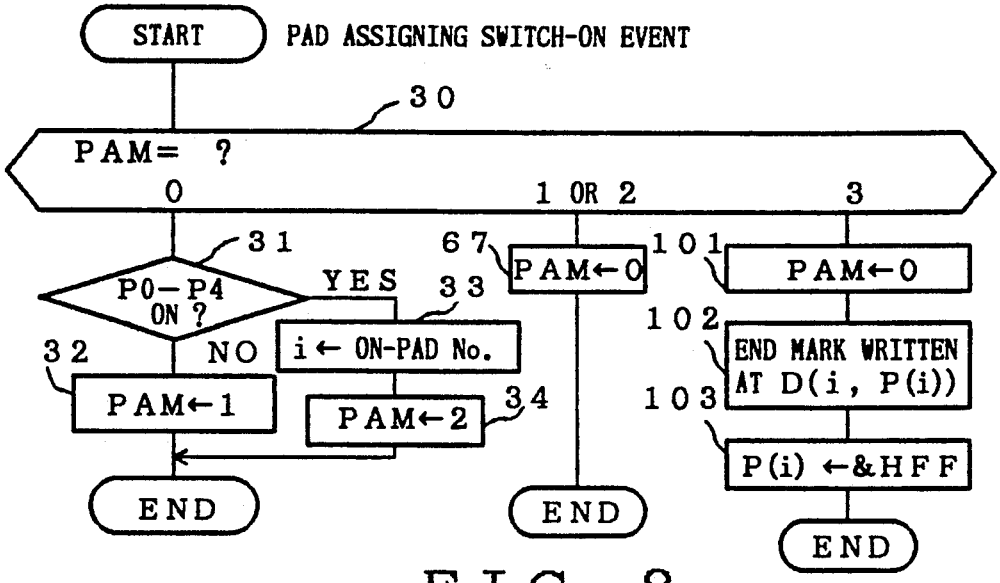
FIG. 8 is a flow chart showing an example of a pad assigning switch-on event processing in the panel switch processing of FIG. 3.
Figure 9:
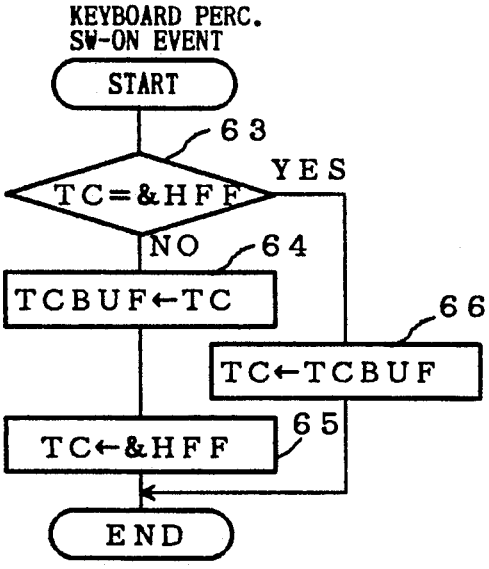
FIG. 9 is a flow chart showing an example of a keyboard percussion switch-on event executed in the panel switch processing of FIG. 3.
Figure 10:
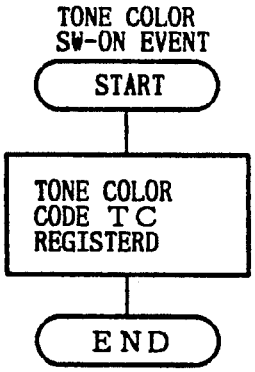
FIG. 10 is a flow chart showing an example of a tone color switch-on event processing executed in the panel switch processing of FIG. 3.

FIG. 3 shows an example of a main routine. In the main routine, an initial setting processing is first executed and then routines of "key processing", "pad processing", "panel switch processing" and "other processing are repeatedly executed. In the "key processing", key switches in the keyboard circuit 14 are scanned to detect on-off states thereof. When the result of scanning is a key-on event, a key-on event processing as shown in FIG. 4 is executed and when the result of scanning is a key-off event, a key-off event processing as shown in FIG. 5 is executed. In the "pad processing", the respective sensors of the pads P0–P4 are scanned to detect on-off states thereof. When the result of scanning is a pad-on event, a pad-on event processing as shown in FIG. 6 is executed and when the result of scanning is a pad-off event, a pad-off processing as shown in FIG. 7 is executed. In the "panel switch processing", operators and switches in the panel switch circuit 15 are scanned to detect on/off states thereof and various processings are executed on the basis of results of detection. An example of processings executed in the "panel switch processing" is shown in FIGS. 8, 9 and 10. In the "other processings", various other processings are executed. One of the other processings is a sequence control processing shown in FIG. 11.

Figure 12:
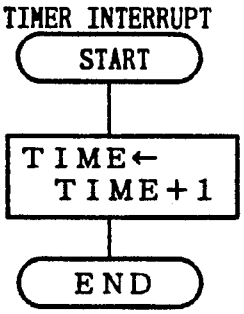
FIG. 12 is a flow chart showing an example of a timer interrupt processing.

A periodical interrupt is made by clock pulse of the timer 20 during execution of the main routine. In that case, a timer interrupt processing of FIG. 12 is executed. In this processing, contents of a timer register TIME are increased by 1. The timer TIME is in a free-run state and its overflow is ignored.

In the initial setting processing, predetermined initial data may be preset in the pad memories PDM0–PDM4. By doing so, predetermined plural tones can be initially assigned to the pads P0–P4 when the power is turned on. It is however not essential to perform such initial setting.

SELECTION OF THE PAD MODE

The pad mode can be selected by operating a pad assigning switch PASW provided in the panel switch circuit 15 during the pad assigning processing. More specifically, in the present embodiment, the pad assigning mode is determined by operation of the pad assigning switch PASW and the pad mode is determined in accordance with this pad assigning mode.

There are four pad assigning modes of 0–3. These four pad assigning modes are designated in the following manner depending upon the contents of the register PAM.

PAM=0: Play mode: This is a mode in which a normal performance is made, i.e., a mode in which the pad assigning is not performed.

PAM=1: This is a mode in which plural tones to be generated simultaneously are assigned to a desired one pad. When this mode has been selected, the simultaneous tone generation mode is selected as the pad mode. In this embodiment, this mode is selected when the pad assigning switch PASW is operated before a desired pad is operated.

PAM=2: Sequential tones assigning preparation mode: This is a mode indicating the first state (preparation state) when plural tones to be sequentially generated are to be assigned to one desired pad. When this mode has been selected, the sequential tone generation mode is selected as the pad mode. In this embodiment, this mode is selected by operating the pad assigning switch PASW while operating a desired pad.

PAM=3: Sequential tones assigning memory mode: This is a mode indicating that the processing has entered the storing operation in the sequential tone assignment. In this embodiment, this mode is brought about by selecting a tone to be assigned by depression of a desired key in the sequential tone assigning preparation mode (PAM=2).

Upon operation of the pad assigning switch PASW, the pad assigning switch on event routine shown in FIG. 8 is executed. First, in step 30, contents of the pad assigning mode register PAM are examined and, when PAM is 0, the routine proceeds to step 31 in which whether or not any one switch of the pad switches P0–P4 has been turned on at the same time as the pad assigning switch PASW has been turned an is examined. When result is NO, the routine proceeds to step 32 in which the pad assigning mode PAM is set to 1. The plural tones assigning mode is thereby selected.

When step 31 is YES, the routine proceeds to step 33 in which the pad number of the pad which has already been turned on is set in a register i. Then, the routine proceeds to step 34 in which the pad assigning mode PAM is set to 2. The sequential tone assigning preparation mode is thereby selected.

By operating the pad assigning switch PASW again, the pad assigning processing can be ended as will be described later.

Figure 13:
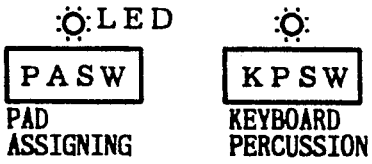
FIG. 13 is a diagram showing an example of a switch provided in the panel switch circuit of FIG. 1 and a display associated therewith.

A display such as LEDs is provided beside the pad assigning switch PASW as shown in FIG. 13 to perform a display corresponding to the state of the pad assigning mode PAM. For example, by performing a control so that the display is extinguished when PAM is 0 and is lighted when PAM is not 0, the fact that the pad assigning processing is being executed can be displayed.

ASSIGNING OF PLURAL TONES

Upon setting to PAM=1 as described above, the plural tones assigning mode is selected. In this state, a desired pad (one of P0–P4) to which assignment is to be made is depressed (or turned on). The pad-on event processing shown in FIG. 6 is started in the following manner and tones which are assigned to the pad are generated.

First, the pad number of the pad which has been depressed (or turned on) is stored in a register PN (step 35). Then, whether the pad assigning mode PAM is 2 or 3 is examined (step 36). Since PAM is currently 1, the result is NO and the routine proceeds to step 37 in which the pad number of the register PN is stored in the register i. Then, pad data PM (PN) is read from the pad memory PDM corresponding to the pad number stored in the register PN (one of PDM0–PDM4) and whether it is "0" or not is examined. If the result is "0", it signifies the simultaneous tone generation mode, so, by processings of steps 39 and 40, pad-assigned tone data PAT (PN) are read from the pad memory PDM, plural tones corresponding to the pad assigned tone data PAT(PN) are assigned to different channels and the plural tones are generated from the tone signal generation circuit 17. If the result of step 38 is not "0", it signifies the sequential tone generation mode, so, by processings of steps 41–47 and FIG. 11, event data and duration data for each of sequential tones are sequentially read from the sequence data area of the pad memory PDM, these sequential tones are assigned to proper channels and thereafter are generated from the tone signal generation circuit 17. Details of the tone generation control in the simultaneous tone generation mode and sequential tone generation mode will be described later.

In the above described manner, the player can confirm a tone which has already been assigned to the pad by listening to the tone. Then, the player depresses a desired key which is to be newly assigned while maintaining the on-state of the pad. The key-on event processing of FIG. 4 is thereby started and the following processings are executed.

First, the key code of the newly depressed key is registered in a register KCD (step 48). Then, whether or not a tone color code TC of a tone color which is currently selected is "&HFF" which is a value indicating a keyboard percussion (step 49). The keyboard percussion herein signifies that a key of the keyboard is used as an operator designating a percussion instrument tone. In this case, the tone color code TC is a predetermined value "&HFF" and the tone color name, i.e., the name of percussion instrument, is designated by the key code.

In a case where the depressed key is a normal scale tone designating key, the routine proceeds to step 50 where a normal tone generation processing (including the key assigning processing for assigning tone generation to any of 16 channels) whereby a tone signal having the tone pitch of the depressed key is generated. In a case where the depressed key is a key designating a keyboard percussion, the routine proceeds to step 51 where a predetermined tone generation processing for the keyboard percussion is executed. In next step 52, tone source channel flag TGCHF for the channel used for the tone generation in all the pad memories PDM0–PDM4 is cancelled. This processing is made for cancelling use of the channel when the channel has already been used in the pad and giving priority to generation of the tone of the currently depressed key which is the newest event. In next step 53, contents of the pad assigning mode PAM are examined and, when PAM=0 or 1, this processing is terminated.

In the foregoing manner, when one or more keys which the player desires to assign to the pad have been depressed, the above described processings are executed with respect to the depressed key or keys. When the player does not desire to assign a once depressed key to the pad, he has only to release the key. When a pad which has been in an on state is finally turned off while one or more desired keys are being depressed, the pad-off event processing shown in FIG. 7 is started and the following processing is executed for assigning a tone or tones corresponding to one or more keys which are being depressed to the pad.

First, the pad number of the pad which has been turned off is stored in the register PN (step 54). Then, pad mode data PM(PN) is read from one of the pad memories PDM0–PDM4 corresponding to the pad number of the register PN (this pad memory is designated by PDM(PN) and whether PM(PN) is "0" or not is examined (step 55). If the result is YES, the routine proceeds to step 550 where pad tone color data PTC(PN) is read from the pad memory PDM(PN) and whether PTC(PN) is &HFF or not is examined. If the result is YES, the routine proceeds to step 56 where a key-off signal is supplied to the tone signal generation circuit 17 (designated as TG in the flow chart) in correspondence to the channel in which the tone source channel flag TGCHF in the pad memory PDM(PN) is on (designated as CH in the flow chart). Since the tone which has been assigned to the pad is being generated, this processing is made for cancelling this assignment of the tone. In step 57, tone source channel flag TGCHF in the pad memory PDM(PN) concerning the turned off pad is all cancelled.

Even when PM(PN) is "0", i.e., the simultaneous tone generation mode, step 550 is NO in the case of the keyboard percussion tone and, in this case, the routine proceeds to step 57 without executing step 56. This is because the keyboard percussion tone is cancelled without supplying a key-off signal thereto.

In a case where the already assigned tone concerning the pad is a sequential tone, PM(PN) is "1" and step 55 is NO and, in this case, the routine proceeds to step 58 without executing steps 56 and 57. This is because the sequential tone is cancelled by the event data.

In next step 58, whether or PAM=1 and PN=i is checked. In the present example, the mode is the plural tone assigning mode and therefore the pad assigning mode PAM=1. The pad number concerning the newest pad-on event is stored in the register i (step 37 in FIG. 6) and the pad number concerning the current pad-off event is stored in the register PN. Normally, PN is i and step 58 therefore becomes YES and the routine proceeds to step 59. In step 59, presence or absence of a currently depressed key is examined. If there is a key or keys which is currently being depressed, the routine proceeds to steps 60–62 in which assigned data is written in the pad memory PDM(PN) (one of the pad memories PDM0–PDM4) corresponding to the pad number designated by the register i. More specifically, pad mode data PM(i) in the pad memory PDM corresponding to the pad number i is set to "0" to store that the simultaneous tone generation mode has been selected in correspondence to this pad (step 60). The tone color code TC representing the currently selected tone color is stored as pad tone color data PTC(i) in the pad memory PDM corresponding to the pad number i (step 60). The key code of the currently depressed key or keys is written as pad assigned tone data PAT(PN) in the pad memory PDM corresponding to the pad number i (step 61). In this case, key codes of 5 tones at a maximum can be written. When there are 6 or more keys which have been depressed simultaneously, 5 keys are selected in accordance with a predetermined preferential selection order and the key codes of the selected keys are written. The preferential selection order may be determined as desired by, for example, giving priority to a higher tone or a lower tone or the newest depressed tone. An on-flag "1" representing assignment is provided in correspondence to the written key code. When the number of simultaneously depressed keys is less than 5, data "&H00" representing the absence of a key code and an off-flag "0" are provided to a remaining area in which no key code has been stored (step 62).

In the foregoing manner, when the pad which has been in an on state is turned off while one or more keys which the player desires to assign to the pad are being depressed, information of tones corresponding to the key or keys is stored in the pad memory PDM corresponding to this pad. Thus, assignment of one or more desired keys to the pad is executed.

In a case where the player has confirmed an assigned tone by causing the assigned tone to be generated by turning on a certain pad and he has no intention to change the assigned tone, he does not perform a key depression operation for selecting a new tone to be assigned but turns off the pad. In this case, step 59 becomes NO and, therefore, the processing is terminated without executing steps 60–62.

The tone color of an assigned tone can also be selected as desired. In the present embodiment, when a scale tone is assigned to the pad, the number of tone color which can be assigned to one pad is only one. In this case, a desired tone color to be assigned is previously selected by the panel switch circuit 15. When the tone color switch for the desired tone color is turned on, the tone color switch on event processing shown in FIG. 10 is executed and a tone color code TC corresponding to the turned on tone color switch is registered as information of the selected tone color. By storing this tone color code TC as pad tone color data PTC(i) in step 60 shown in FIG. 7, assignment of the desired tone color is performed. In this case, tone color information for plural tones assigned to one pad is common. Alternatively, however, a different tone color may be assigned to each tone.

It is also possible to assign a keyboard percussion tone to the pad. For this purpose, the mode is preset to a keyboard percussion mode. The keyboard percussion mode is set and reset by operating a keyboard percussion switch KPSW provided in the panel switch circuit 15. Upon turning on of the keyboard percussion switch KPSW, a keyboard percussion on event processing shown in FIG. 9 is executed. First, whether or not the tone color code TC is the predetermined value "&HFF" representing the keyboard percussion mode is examined (step 63). When the mode is not the keyboard percussion mode, the result is NO and the tone color code TC at this time is stored in a buffer TCBUF (step 64) and thereafter the tone color code TC is changed to the code "&HFF" representing the keyboard percussion mode (step 65). After changing the mode to the keyboard percussion mode, a desired pad is turned on and a key corresponding to the desired keyboard percussion tone is depressed. Then, when the pad is turned off as described above, the key code of the depressed key is stored, together with the tone color code TC representing the keyboard percussion mode, in the pad memory PDM. When the keyboard percussion mode is to be cancelled, the keyboard percussion switch KPSW is turned on again. Step 63 thereupon becomes YES and the tone color code which has been stored in the buffer TCBUF is registered again as the tone color code TC (step 66). As shown in FIG. 13, a display consisting of LEDs, for example, is provided beside the keyboard percussion switch KPSW to perform a display corresponding to the state of the keyboard percussion mode. For example, when the keyboard percussion mode has been selected (when TC is &HFF), the display is lighted and when it has not been selected (when TC is not &HFF), the display is extinguished.

When the plural tone assigning mode is to be ended, the pad assigning switch PASW is turned on again. The mode is judged to be PAM=1 (the plural tone assigning mode) in step 30 of FIG. 8 and the routine proceeds to step 67 where contents of the pad assigning mode PAM are reset to PAM=0.

ASSIGNMENT OF SEQUENTIAL TONES

When the player desires to perform assignment of sequential tones, he first depressed (or turns on) a desired pad (one of the pads P0–P4). The pad-on event processing shown in FIG. 6 thereupon is started. Since at this time PAM is not 2 or 3, step 36 becomes NO and the processing described above is executed to generate tones which are currently assigned to the pad. When new sequential tones are to be assigned upon confirming the already assigned tones, the pad assigning switch PASW is turned on. Step 31 in FIG. 8 thereupon becomes YES and PAM is set to 2 to bring about the sequential tone assigning preparation mode. After PAM has been set to 2, the pad may be turned off any time. The assignment and storage of the sequential tones are made not at the off timing of the pad but at each key depression or release event.

After the pad assigning mode has been set to PAM=2, the player sequentially depresses desired keys which he desires to assign as the sequential tones at a desired timing. In this case, two or more keys may be depressed simultaneously in a part of the sequential assignment process. In accordance with this series of key operation, the key-on event processing shown in FIG. 4 is executed during depression of the keys and the key-off event processing shown in FIG. 5 is executed during release of the keys. At each event, the sequence data is stored in the pad memory PDM and the sequential tones are assigned as will be described below.

When a key has been depressed, the key code of the depressed key is registered in the register KCD and the tone of the key code is generated by the processings of steps 48-52 of FIG. 4.

When the first key has been depressed, the pad assigning mode is PAM=2, the judgement of PAM=2 is made in step 53 and the routine proceeds to step 68. In step 68, the pad assigning mode is set to PAM=3 to bring about the sequential tone assigning mode. Then, the pad mode data PM(i) in the pad memory PDM (one of PDM0-PDM4) corresponding to the pad number of the register i is set to "1" to store the fact that the sequential tone assigning mode has been selected in correspondence to this pad (step 69) and the tone color code TC representing the tone color which is currently selected as the pad tone color data PTC(i) is stored (step 69).

Then, a predetermined one phrase time length data MJL is added to the current value of the timer TIME and the result of the addition is stored in a sequence end time register ENDT (step 70). This processing is made for limiting one phrase of the sequential tones to a time length corresponding to one phrase. Then, the pointer (i) in the pad memory PDM corresponding to the pad number i to which assignment is to be made is set to an initial value 0 (step 71). Nextly, in the sequence data area in the pad memory PDM corresponding to the pad number i (see the part (e) of FIG. 2, the key code in the register KCD (i.e., the key code of the key which has just been depressed) and the on-event flag "1" are stored as first event data E(i,0) designated by the pointer (i)=0 (step 72). The current value of the timer TIME is set in an old time register OLDT thereby to store the time at which the current event has occurred (step 73).

When the second and subsequent keys have been depressed, the pad assigning mode has already become PAM=3, the judgement of PAM=3 is made in step 53 and the routine proceeds to step 74. In step 74, the value of the old time register OLDT is subtracted from the current value of the timer TIME to obtain difference between the time at which the preceding event occurred and the time at which the current event has occurred, i.e., an event time interval, and this event time interval is stored in a duration register D. Then, in the sequence data area in the pad memory PDM corresponding to the pad number i (see the part c of FIG. 2), the time interval data stored in the duration register D is stored as duration data D(i,P(i)) of an event order designated by the pointer P(i) (step 75). If, for example, P(i) is 0, the time interval data of the duration register D is stored as duration data D(i,0) of the first event order. Then, the pointer P(i) is increased by I and next event order (i.e., the order of the current event) is designated (step 76).

In next step 77, in the sequence data area in the pad memory PDM corresponding to the pad number i (see the part c of FIG. 2), the key code of the register KCD (i.e., the key code of the key concerning the current on-event) and the on-event flag "1" are stored as the event data E(i, P(i)) of an event order designated by the pointer P(i). In next step 78, whether the value of the pointer P(i) has reached the maximum value 19 or not is examined. If the result is NO, the routine proceeds to step 79 where the current value of the timer TIME is set to the old time register OLDT.

Thus, in correspondence to a new key-on event, the duration data D(i,P(i)) concerning the preceding event order and the event data E(i, P(i)+1) concerning the current event order are written.

When the depressed key has been released, the key-off event processing of FIG. 5 is started. First, the key code of the key which has just been released is registered in the register KCD (step 80). Then, whether or not the tone color code of the currently selected tone color is the value "&HFF" representing the keyboard percussion is examined (step 81). When the released key is a normal scale tone designating key, step 81 is NO and the routine proceeds to step 82 where a normal tone cancellation processing is executed. For example, in the known manner, a key-off signal is provided for the channel to which the released key is assigned and the tone volume envelope of the channel is changed to a decay mode to attenuate generation of the tone signal of the released key. In next step 83, whether the pad assigning mode is PAM=3 or not is examined. In the instant case, the pad assigning mode has already become PAM=3 so that the result is YES and the routine proceeds to step 84.

The processings of steps 84-89 are almost similar to those in steps 74-79. A different point is that in step 87, the key code of the register KCD (i.e., the key code of the key concerning the current off-event) and the off-event flag "0" are stored as the event data E(i. P(i)) of the event order designated by the pointer P(i). Thus, in correspondence to the key-off event also, the duration data D(i, P(i)) concerning the preceding event order and the event data E(i,P(i)+1) concerning the current event data are written in a manner similar to the case of the on-event.

In a case where the released key is a keyboard percussion designating key, step 81 is YES and the key-off event processing is ended without executing subsequent processing. This is because a percussion tone decays regardless of the key release operation so that no particular tone cancellation processing is necessary.

When the maximum value of the pointer P(i) has reached 19 by increment in the step 86, step 88 becomes YES and the routine proceeds to step 90. In this step, the pad assigning mode is set to PAM=0, i.e., a play mode (step 90) and a predetermined end mark code is written at a position of duration data D(i,19) of an event order 19 (step 91). The value of the pointer F(i) is set to "&HFF". The pad assigning processing is thereby terminated.

When the value of the pointer P(i) has reached the maximum value 19 during the key-on event processing, the same processing as described above is executed. That is, step 78 of FIG. 4 becomes YES and processings of steps 93-95 which are entirely the same as steps 90-92 are executed and the pad assigning processing is thereby terminated.

Figure 11:
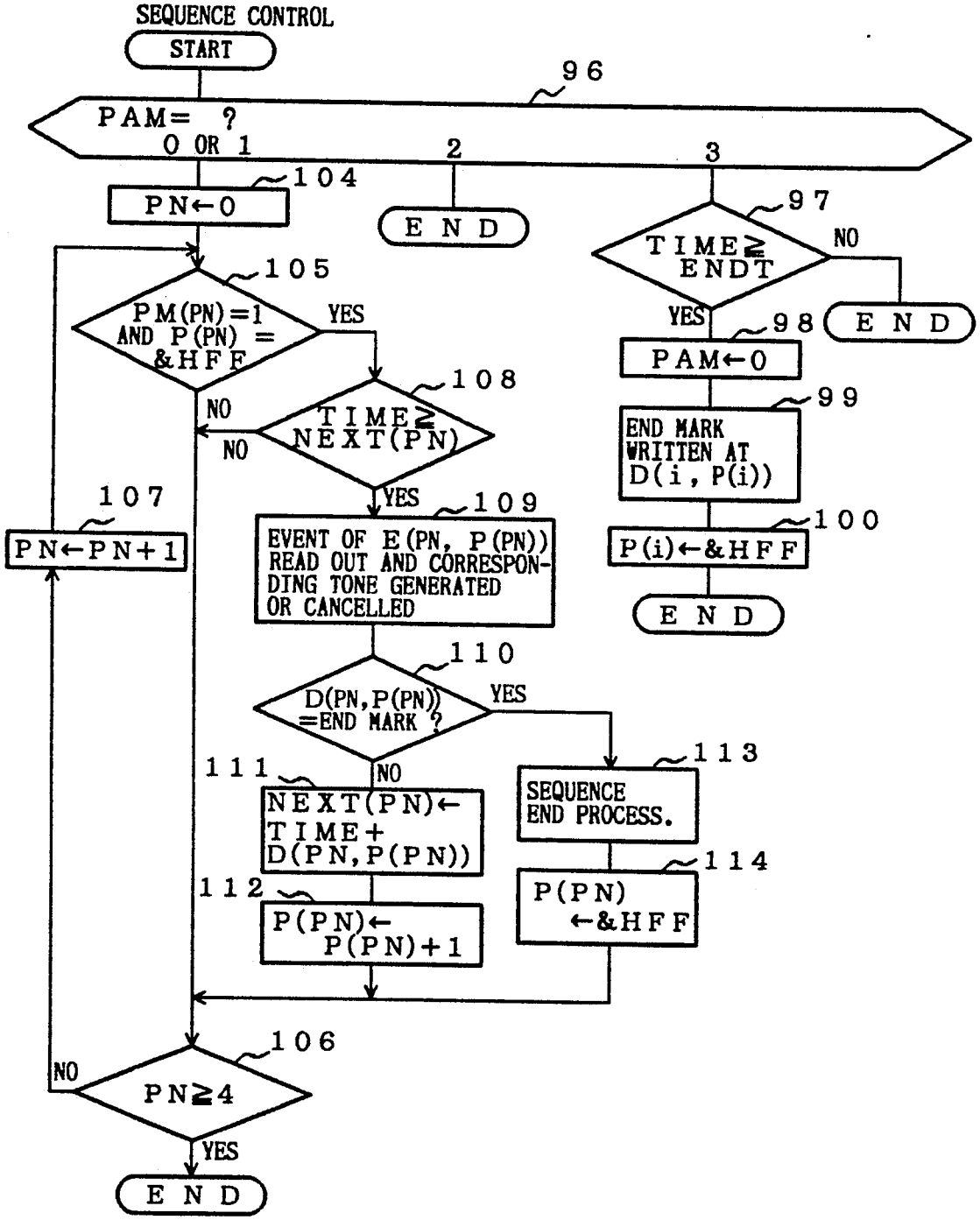
FIG. 11 is a flow chart showing an example of a sequence control processing executed in the main routine of FIG. 3.

At each one circulation of the main routine, the sequence control processing of FIG. 11 is executed. First, the pad assigning mode is checked (step 96). As described above, when the sequential tone assigning memory mode is executed, the pad assigning mode is PAM=3 and the routine in this case proceeds to step 97 where whether the current value of the timer TIME has coincided with the value of the sequence end time register ENDT or exceeded it is examined. If the result is NO, this routine is ended whereas if the result is YES, processings of steps 98-100 are executed. The processings of steps 98-100 are entirely the same as the processings of steps 90-92 of FIG. 5 whereby the sequential tones assigning processing is ended.

The sequential tones assigning processing may also be terminated by turning on the pad assigning switch PASW again during execution of the sequential tones assigning memory mode. In this case, judgement of PAM=3 is made in step 30 of FIG. 8 and processings of steps 101-103 are executed. The processings of steps 101-103 are entirely the same as the processings of steps 90-92 of FIG. 5.

In a case where another pad has been turned on when the sequential tone assigning processing is executed on a certain pad, the pad assigning mode PAM is either 2 or 3 and, therefore, step 36 becomes YES in the key-on event processing of FIG. 6 which is executed when the other pad has been turend on, so that the routine returns to the main routine without executing the key-on event processing.

SIMULTANEOUS GENERATION OF PLURAL TONES

By turning on of a desired pad, plural tones assigned to this pad can be simultaneously generated. As described previously, upon turning on of the pad, the pad-on event processing of FIG. 6 is started. The pad mode data PM(PN) is read from the pad memory PDM(PN) corresponding to the pad and whether it is "0" or not is examined (step 38). If the pad mode which has been selected in correspondence to this pad is the simultaneous tone generation mode, PM(PN) is "0" and processings of steps 39 and 40 are executed, In step 39, one or more key codes which have been assigned to this pad are read from the area of pad assigned tone data PAT(PN) in the pad memory PDM(PN) corresponding to the turned on pad and these key codes are assigned to different channels. In correspondence to the channels to which these key codes have been assigned, the key codes and a key-on signal are supplied to the tone signal generation circuit 17. Pad tone color data PTC(PN) is read from the pad memory PDM(PN) and this data is also supplied to the tone signal generation circuit 17. In corresponding channels of the tone signal generation circuit 17, tone signals corresponding to the one or more key codes are formed with a tone color corresponding to the tone color data and delivered out.

Thus, by a single pad operation, one or more tones which have been assigned to the pad are simultaneously generated. By, for example, assigning a desired chord to the pad, the chord can be performed easily by a single operation of the pad. Since contents assigned to the pad can be changed as desired depending upon the purpose of performance, the limited number of pads can be used efficiently as performance operators for various chords and other desired plural tones and, as a result, performance can be facilitated.

In step 40, the tone source channel flag TGCHF in the pad memory PDM(PN) is turned to "1" in correspondence to the channel which has been decided for assignment in the preceding step.

As described previously, upon turning off of the pad which has been in an on state, the pad-off event processing of FIG. 7 is started. Whether or not the pad mode data PM(PN) of the pad concerning the current off event is "0" and the pad tone color data PTC(PN) is not &HFF (steps 55 and 550). If the pad mode data is the simultaneous tone generation mode and the tone color data is a normal tone color, the routine proceeds to step 56 where a key-off signal is supplied to the channels to which one or more tones assigned to the pad are assigned for tone generation (i.e., channels in which the tone source channel flag TGCHF is on). The tones generated from these channels thereby are brought to a decay state after release of the keys and one more tones corresponding to the pad cease to be generated. Thereafter, the routine proceeds to step 57 where the tone source channel flags TGCHF in the pad memory PDM(PN) concerning the turned off pad are all turend off. In a case where the tone color assigned to the pad is a keyboard percussion tone, step 350 is NO and the routine proceeds to a step 57 without executing step 56. Since the keyboard percussion tone is attenuated without a key-off processing, the processing of step 56 is unnecessary.

When a keyboard percussion tone is generated, it may be generated in an exclusive percussion tone generation channel or device without assigning it to one of the 16 channels in which scale tones are generated.

GENERATION OF SEQUENTIAL TONES

Upon turning on of a desired pad, as described previously, the pad-on event processing of FIG. 6 is started. The pad mode data PM(PN) is read from the pad memory PDM corresponding to the pad and whether it is "0" or not is examined (step 38). If the pad mode which has been selected for the pad is the sequential tone generation mode, PM(PN) is "1" and the routine proceeds to step 41 where the sequential tone generation processing is started.

In step 41, the pointer P(PN) in the pad memory PDM(PN) in the turned on pad is set to 0 to designate the first event order. Then, the event data E(PN, 0) and duration data D(PN,0) of the first event order designated by the pointer P(PN)=0 are read from the sequence data area (see the part c of FIG. 2) in the pad memory PDM(PN) and generation of atone corresponding to the key code designated by the event data E(PN,0) is executed (step 42). This tone generation processing is substantially the same as the above described processing of steps 39 and 40. That is, the key code designated by the event data E(PN,0) is assigned to one of the channels and the key code and a key-on signal and pad tone color data PTC(PN) are supplied to this channel and one tone signal corresponding to this key code is generated with the tone color corresponding to the tone color data PTC(PN) in the channel of the tone signal generation circuit 17 and delivered out. The tone source channel flag TGCHF corresponding to the assigned channel is turned on.

In step 43, whether the read out duration data D(PN,0) is an end mark code or not is examined. If the result is NO, the routine proceeds to step 44 where the duration data D(PN,0) is added to the current value of the timer TIME and the result of the addition is stored in a next event time register NEXT(PN) corresponding to this pad number PN. The value of this NEXT(PN) designates time when next event will occur. Thereafter, the value of the pointer P(PN) is increased by 1 (step 45).

When the read out duration data D(PN,0) is the end mark code, the routine proceeds to step 46 where a predetermined sequence end processing is executed. In this step, a processing necessary for ending generation of the sequential tones such as supplying a key-off signal to the tone signal generation circuit 17 if it has not been supplied yet and turning off all tone source channel flags TGCHF in the pad memory PDM(PN) corresponding to the pad number is executed. Then, the value of the pointer P(PN) is set to a predetermined value &HFF and the processing is ended (step 47).

In the above described manner, in the pad-on event, the processing for generating the sequential tone of the first order assigned to the pad is executed. Processing of the second and subsequent events is executed in the sequence control processing of FIG. 11. This sequence control processing is repeatedly performed each time the main routine is repeated.

Since the pad assigning mode PAM is 0 or 1 in the play mode or the plural tone assigning mode, the routine proceeds from step 96 to step 104 in FIG. 11. In step 104, the pad number register PN is preset to 0. Then, in step 105, the pad mode data PM(PN) and the pointer P(PN) are read from the pad memory PDM(PN) which has been designated by the pad number register PN to examine whether the pad mode data PM(PN) is "1" and the pointer P(PN) is not &HFF. When the tone generation mode assigned to the pad number PN is not the sequential tone generation mode or, even when it is the sequential tone generation mode, the pointer P(PN) is set to the predetermined value &HFF, the routine proceeds to step 106 where whether the pad number PN has reached the maximum value 4 or not is examined. Then the routine returns to step 105 and the above judgement is performed as to the pad number PN which has increased by 1.

When the tone generation mode is the sequential tone generation mode and the pointer P(PN) has not been set to the predetermined end value &HFF yet, step 105 is YES and the routine proceeds to step 108 where next event time data is read from the register NEXT(PN) designated by PN and compared with the current value of the timer TIME. When the current value of the timer TIME coincides with the next event time NEXT(PN) or has exceeded it, the routine proceeds to step 109. When the current value of the timer TIME has not reached the next event time NEXT(PN), the routine proceeds to step 106 where the loop of the above described steps 106 and 107 is repeated. Upon completion of the above check with respect to all of the 5 pad numbers, PN=4 becomes YES and the sequence control processing thereby is terminated.

When the current value of the timer TIME has reached the next event time NEXT(PN) in the course of repeating this sequence control processing, step 108 becomes YES and the routine proceeds to step 109. In step 109, the current value of the pointer P(PN) of the pad memory PDM(PN) designated by PN is read out and the event data E(PN, P(PN)) of the event order designated by the pointer P(PN) and duration data D(PN,P(PN)) are read from the sequence data area (see the part c of FIG. 2) in the pad memory PDM(PN) and a tone generation or cancellation processing of a tone corresponding to the key code designated by the event data E(PN,P(PN)) is executed. When the flag of the event data E(PN, P(PN)) is an on-flag representing depression of the key, a tone generation processing is executed and when it is an off-flag representing release of the key, a tone cancellation operation is executed. This tone generation processing is almost the same processing as the above described processing in step 42. That is, the key code designated by the event data E(PN,(PN)) is assigned to some channel and the key code, a key-on signal and tone color data PTC(PN) are supplied to the channel of the tone signal generation circuit 17 to generate a tone signal corresponding to the key code with the tone color corresponding to the tone color data in the channel of the tone signal generation circuit 17. The tone source channel flag TGCHF corresponding to the assigned channel is turned on. In the tone cancellation processing, a key-off signal is supplied to the tone signal generation circuit 17 in correspondence to the channel to which the key code concerning the off-event designated by the event data E(PN,(PN)) has been assigned. The particular channel to which the key code has been assigned can be detected by the tone source channel flag TGCHF. As regards the channel to which the key-off signal has been supplied, the tone source channel flag may be turned off.

In the above described manner, in the case of the off event, the tone cancellation processing is executed in step 109 and the sequential tone concerning the off-event is cancelled. In the case of the on-event, the tone generation processing is executed in step 109 and a new sequential tone is thereby generated.

In step 110, whether or not the read out duration data D(PN,(PN)) is the end mark code is examined. If the result is NO, the routine proceeds to step 111 where the duration data D(PN,(PN)) is added to the current value of the timer TIME and the result of the addition is stored in the next event time register NEXT(PN). Thereafter, the value of the pointer P(PN) is increased by 1 (step 112).

When the read out duration data D(PN, P(PN)) is the end mark code, the routine proceeds to steps 113–114 where a predetermined sequence end processing and a pointer resetting processing similar to the above described processings in steps 46 and 47 (FIG. 6) are executed.

In the foregoing manner, plural tones which have been assigned as the sequential tones in accordance with the event data and duration stored in the sequence data area are sequentially read out.

THE SECOND EMBODIMENT

In the above described embodiment, it is only tone source signals such as scale tones and rhythm tones that can be assigned to the performance operators, i.e., the pads P0–P4 and, as far as setting operators are concerned, setting information of the tone color switch only can be assigned simultaneously. The second embodiment to be described below is an embodiment in which not only a set state of tone color setting operator but set states of other various setting operators for setting, e.g., tone volume and effects can be assigned to a desired one of performance operators, e.g., the pads P0–P4. In this second embodiment, the hardware structure of the electronic musical instrument of the second embodiment is the same as that shown in FIG. 1 as in the first embodiment. Specific components of the second embodiment are mostly the same as those shown in FIGS. 2 to 13. In some points, however, modifications are made as will be described below. The following description will be made about the modified points and the structure and operation of the second embodiment which will not be described are the same as those of the first embodiment.

These setting operators are provided in the panel switch circuit 15. An example of a part of the panel switch circuit 15 will be described with reference to FIG. 14. An automatic accompaniment performance switch AASW is a switch for selecting an automatic accompaniment function such as an automatic bass chord performance. An automatic harmony switch AHSW is a switch for selecting imparting of an automatic harmony effect. The automatic harmony effect is a harmony effect obtained by automatically adding an automatic harmony tone, i.e., an automatic performance tone, to a tone which is being played.

The automatic harmony effect will be described somewhat more in detail. A chord, for example, which has been produced in the keyboard is detected and a tone to be added is decided in accordance with the type of the chord and separately designated automatic harmony type designation data. As the automatic harmony types, there are, for example, duet, trio, octave and strum. Duet is an effect of automatically adding one tone which is lower (or higher) by a predetermined note interval to a main performance tone (e.g., a melody tone). Trio is an effect of automatically adding two different tones which are lower (or higher) by predetermined intervals to a main performance tone (e.g., a melody tone). Octave is an effect of automatically adding a tone which is lower (or higher) by one octave to a main performance tone (e.g., a melody tone). Strum is an effect of automatically adding different arpeggio tones which are lower (or higher) by predetermined note intervals to a main performance tone (e.g., a melody tone). There may be several different types for each of the automatic harmony types including duet, trio, octave and strum depending upon difference in the note interval or pattern of a tone or tones to be imparted. The type of a chord to be performed is used for deciding the note interval of the automatic tone to be added. A main performance tone to which the automatic harmony is applied is a melody tone, for example, and this is, for example, the highest depressed key in a keyboard or key range for melody performance. When a tone which has been assigned to a pad is generated, such automatic harmony tone may be added to this pad assigned tone. Alternatively, whether the currently generated tone is a tone assigned to the pad or not may be automatically judged and an automatic harmony tone may be added only to the assigned tone.

Figure 14:
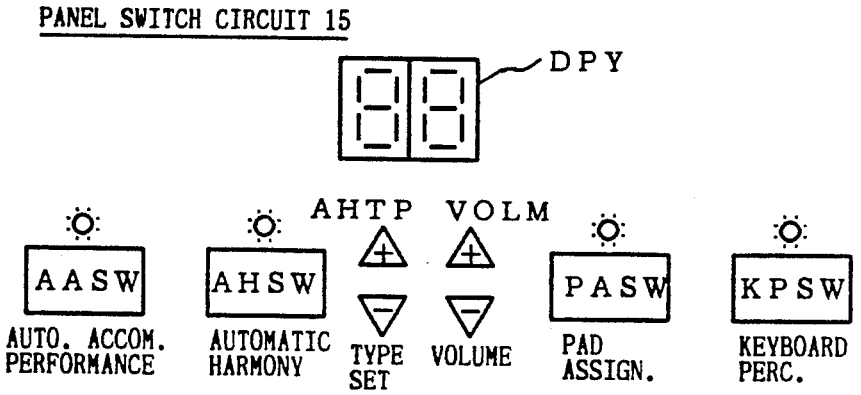
FIG. 14 is a diagram showing an example of switches provided in a panel switch circuit of the second embodiment of the invention and a display associated therewith.

Reverting to FIG. 14, an automatic harmony type setting switch AHTP is a switch for setting the above described automatic harmony type and consists, for example, of an increment switch and a decrement switch. In response to depression of the increment switch or decrement switch of the type setting switch AHTP, numerical data displayed by a data display DPY increases or decreases whereby a desired automatic harmony type can be selected. As in the above described pad assigning switch PASW and the keyboard percussion switch KPSW, light emitting diodes LED are provided for the automatic accompaniment performance switch AASSW and the automatic harmony switch AHSW and are lighted when the automatic accompaniment performance or automatic harmony effect is turned on.

A volume switch VOLM is a switch for setting a volume level of a tone and consists, for example, of an increment switch and a decrement switch. In response to depression of the increment switch or decrement switch of the volume switch VOLM, numerical data displayed by the data display DPY increases or decreases whereby a desired tone volume can be set.

By way of an example, a case where tone volume information set by the volume switch VOLM and automatic harmony information set by the automatic harmony switch AHSW and the type setting switch AHTP can be assigned to a desired performance operator, i.e., one of the pads P0–P4, will be described below.

Figures 15A, 15B, 15C:
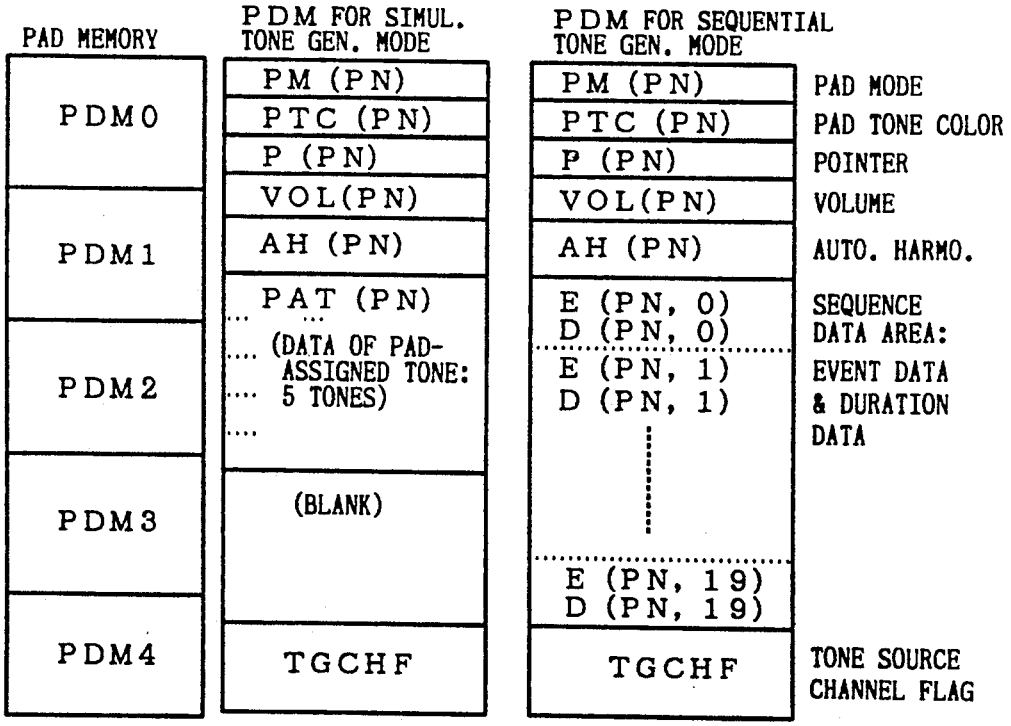
FIGS. 15*a*, 15*b* and 15*c* comprise an example of a memory format of a pad memory in the data and working RAM in the second embodiment.

In this second embodiment, memory data format of the pad memory in the data and working RAM 12 is shown in FIGS. 15*a*, 15*b*, and 15*c*. FIGS. 15*a*, 15*b* and 15*c* correspond to FIGS. 2*a*, 2*b* and 2*c* and FIG. 15*a* is the same as FIG. 2*a* but FIGS. 15*b* and 15*c* are modified. Memory data format of the pad memory (PDM) during the simultaneous tone generation mode is shown in FIG. 15*b*. In comparison with FIG. 2*b*, a memory section which stores tone volume setting data VOL(PN) and automatic harmony data AH(PN) as header data (set data which is common to all tones assigned to the pad) is added. Tone volume setting data VOL(PN) is tone volume information set by the volume switch VOLM for the pad of the number PN. The automatic harmony data AH(PN) is automatic harmony setting information (automatic harmony on-off setting data and automatic harmony type setting data) set by the automatic harmony switch AHSW and the type setting switch AHTP for the pad of the pad number PN.

An example of memory data format of the pad memory (PDM) during the sequential tone generation mode is shown in FIG. 15*c*. In the same manner as described above, in comparison with FIG. 2*c*, a memory section which stores tone volume setting data VOL(PN) and automatic harmony data AH(PN) as header data is added. In addition, setting information of these tone color, volume and automatic harmony is stored as event data E(PN,p) in the sequence data area. In this example, not only key-on and key-off but changes in the tone color switch, volume switch VOLM, automatic harmony switch AHSW and type setting switch AHTP in the panel switch circuit 15 are detected as events for sequential tone generation control and stored in the sequence data area. In the format of FIG. 15*c*, therefore, the event data E(PN, p) consists of the event code and data designating contents of data concerning the event code. The event codes are codes designating event types such as key-on, key-off, tone color, volume, automatic harmony on-off and automatic harmony type. The event data is data designating specific data contents such as contents of key-code, tone color code, tone volume setting data and automatic harmony type setting code. In the same manner as described above, duration data D(PN,p) representing time interval from the particular event to next event is also stored.

During generation of sequential tones, the sequential tones are initially controlled by the tone color, tone volume and automatic harmony setting information PTC(PN), VOL(PN) and AH(PN). As time elapses, however, the event data E(PN,p) is read out and, if information corresponding to change in the set state of the tone color, tone volume or automatic harmony is included in the event data, a control is made so that the set state of the tone color, tone volume or the automatic harmony effect added to the sequential tones will be changed.

Figure 16:
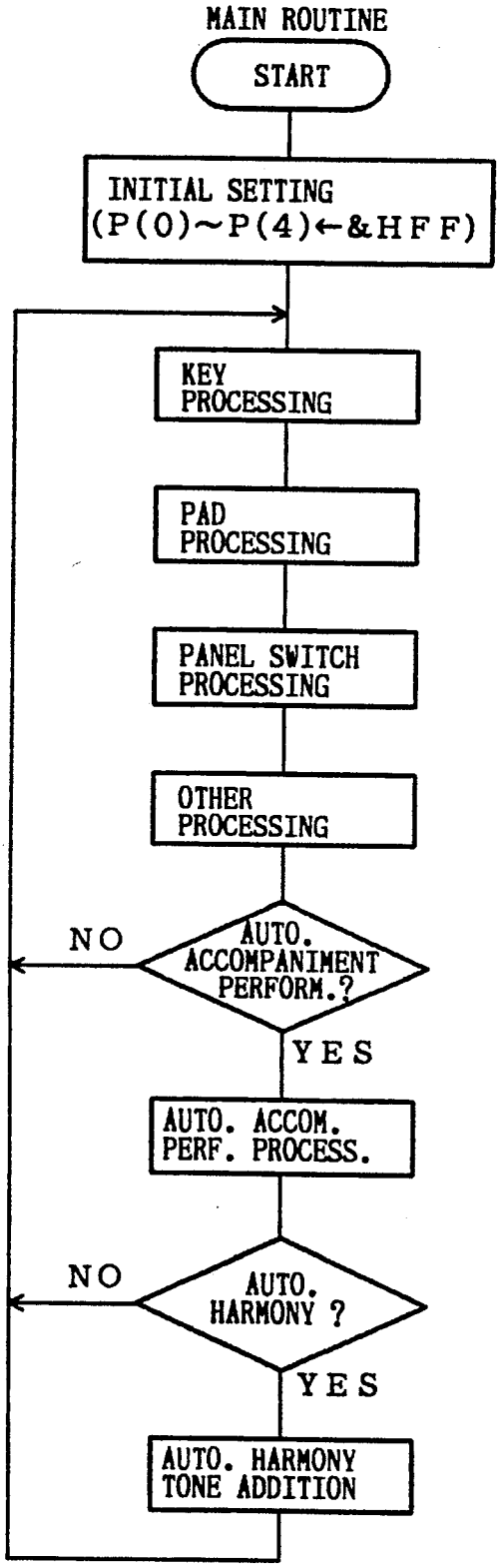
FIG. 16 is a flow chart showing an example of a main routine executed by a microcomputer in the second embodiment.

FIG. 16 shows the main routine. The main routine of FIG. 16 is different from the main routine of FIG. 3 in that processings for the automatic accompaniment performance and the automatic harmony are specifically described. When the automatic accompaniment performance is on, the processing for the automatic accompaniment performance is executed and thereafter whether the automatic harmony is on or not is examined. If the automatic harmony is on, a processing for adding an automatic harmony tone is executed. If the automatic harmony is not on, addition of an automatic harmony tone is not made. In the initial setting processing, a predetermined end value &HFf is written as a designating value of the pointer P(0)-P(4) in the pad memory (PDM) corresponding to the pads P0-P4. This processing is made for initially setting the sequential tone generation mode in each pad to a stop mode.

PROCESSING IN THE PLURAL TONE ASSIGNING MODE

Figure 19:
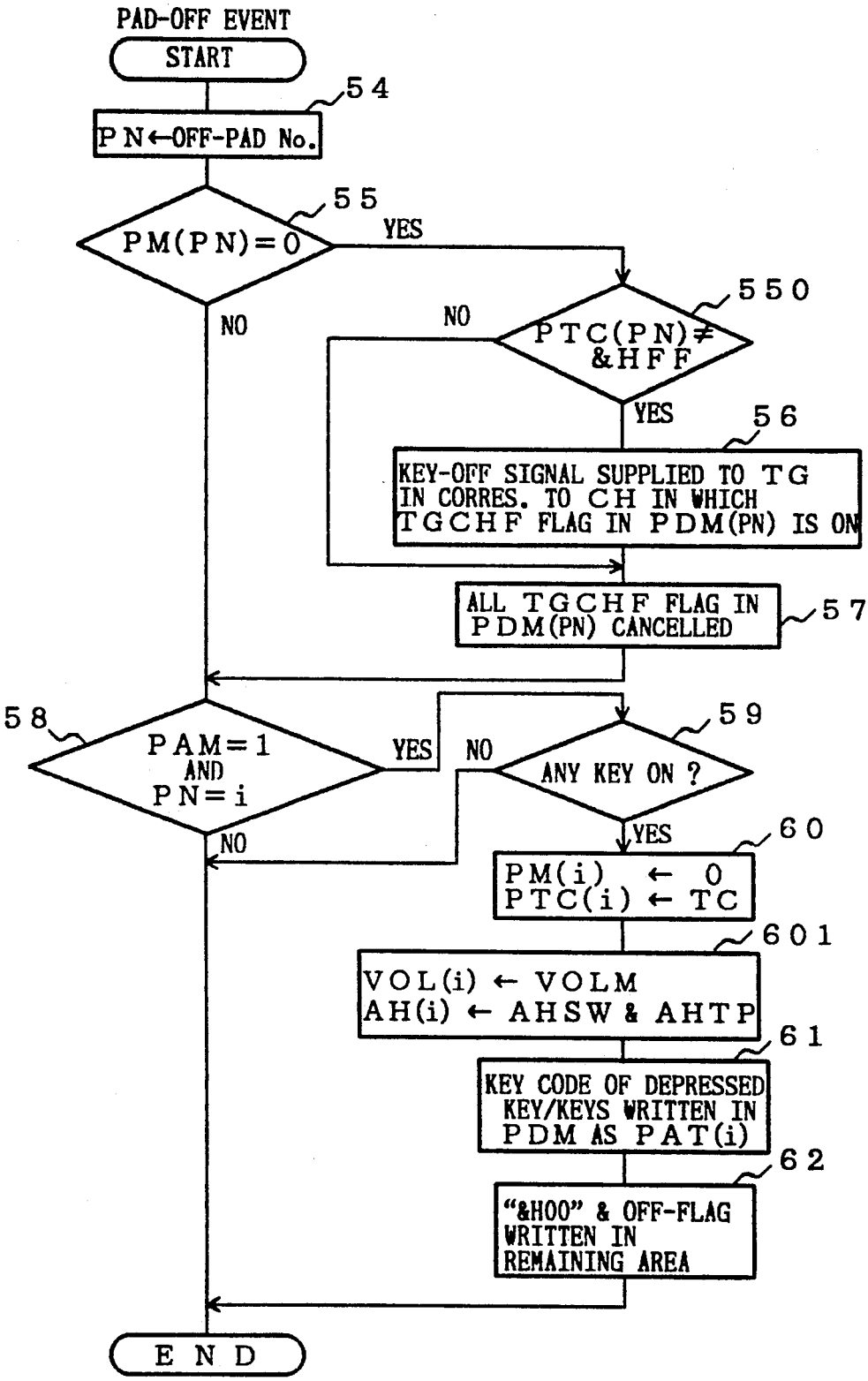
FIG. 19 is a flow chart showing an example of a pad-off even processing executed in the pad processing of FIG. 16.

In this case, as a processing associated with the plural tone assigning mode, the pad-off event processing of FIG. 7 is modified as shown in FIG. 19. FIG. 19 is different from FIG. 7 in that step 601 has been inserted after step 60 and is the same as FIG. 7 in other respects of the processing.

First, as described previously, the pad assigning switch PASW is operated to set the pad assigning mode PAM to 1. At a suitable time point, a desired tone color is selected in the panel switch circuit 15 to set the tone volume to a desired value by operating the volume switch VOLM and desired selection or setting is made concerning the automatic accompaniment performance and automatic harmony by operating the switches AASW, AHSW and AHTP. The selection state or set state of these setting operators is scanned for detection by a panel switch processing in the main routine and stored in a proper buffer register. Then, in the same manner as described previously, a desired pad to which assignment is to be made is turned on and one or more keys which the player desires to assign to the pad are depressed. Thereafter, the pad which has been on is turned off.

Step 58 thereupon becomes YES in the processing of FIG. 19 and the routine proceeds to step 59 where it is confirmed that there is a key which is being depressed and thereafter processings of steps 60-62 are executed. In these processings, as described previously, data is written in the pad memory PDM corresponding to the turned off pad (pad number PN=i). More specifically, in step 60, the pad mode data PM(i) is set to "0" to register that the tone generation mode is the simultaneous tone generation mode and a tone code TC of the tone color which has been set by the tone color switch is registered as pad tone color data PTC(i). Thereafter, in step 601, tone volume setting information which has been set by the volume switch VOLM is registered as tone volume setting data VOL(i) corresponding to the pad (pad number=i) and automatic harmony on-off setting information set by the automatic harmony switch AHSW and automatic harmony type setting information set by the type setting switch AHTP are registered as automatic harmony data AH(i) corresponding to the pad (pad number=i). Thereafter, processings of steps 61 and 62 are executed in the same manner as previously described. Thus, setting information of volume and automatic harmony are registered as the header in the format shown in the part b of FIG. 15.

PROCESSING DURING ASSIGNMENT OF THE SEQUENTIAL TONES

Figure 17:
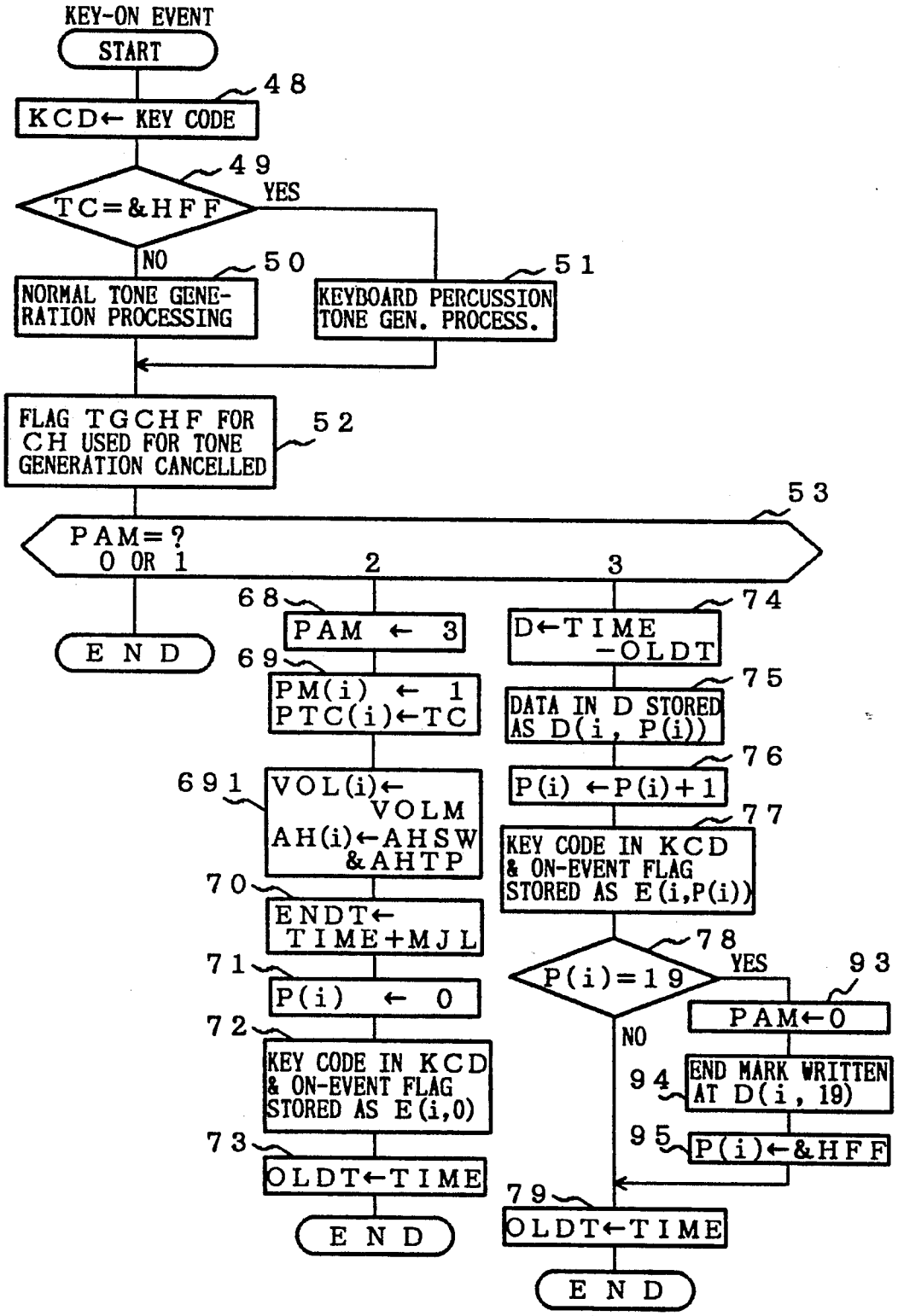
FIG. 17 is a flow chart showing an example of a key-on event processing executed in the key processing of FIG. 16.

In the second embodiment, as a processing associated with the assignment of the sequential tones, the key-on event processing of FIG. 4 is modified as shown in FIG. 17. FIG. 17 is different from FIG. 4 in that step 691 has been inserted after step 69 and is the same as the processing of FIG. 4 in other respects. In a normal tone generation processing of step 50, however, volume of a generated tone is con-trolled in accordance with data of a tone volume data buffer VOLBUF to be described later.

The processing of step 691 is the same as the above described processing of step 601 of FIG. 19. By adding the processing of step 691, in the same manner as described previously, tone volume setting data VOL(i) and automatic harmony data AH(i) are registered as header data with the format shown in the part c of FIG. 15 in the pad memory PDM corresponding to the pad (pad number PN=i) to which the sequential tones are assigned. More specifically, data of tone volume and automatic harmony which are to be set as header data are preset to desired states by operating the volume switch VOLM and the switches AHSW and AHTP. Then, in the same manner as described previously, the pad assigning mode is set to PAM=2 and the first key of the sequential tones is depressed. Thereupon, judgement of PAM=2 is made in step 53 of FIG. 17 and processings of steps 68-73 are executed. In the course of these processings, processing of step 691 is executed and the tone volume setting data VOL(i) and automatic harmony data AH(i) are registered as header data.

Figure 21:
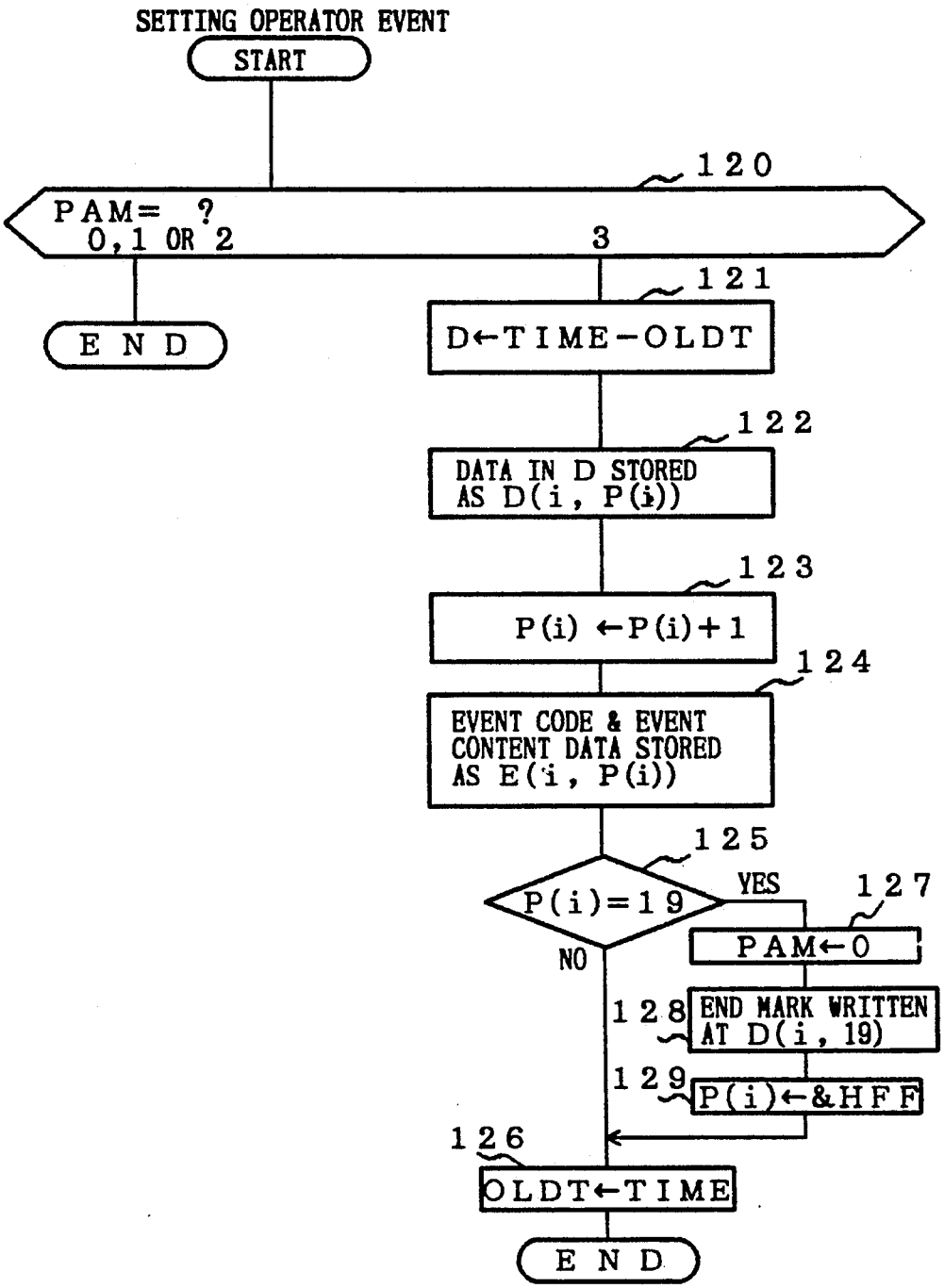
FIG. 21 is a flow chart showing an example of a setting operator event processing executed in the panel switch processing of FIG. 16.

For storing setting data of tone color, tone volume and automatic harmony in the pad memory PDM as event data in the same manner as data of key-on and key-off during assigning of the sequential tones, a setting operator event processing as shown in FIG. 21 is executed. When a selection or set state by the tone color switch, volume switch VOLM, automatic harmony switch AHSW or automatic harmony type switch AHTP has been changed, the event processing of FIG. 21 is started.

In FIG. 21, the pad assigning mode PAM is examined in step 120. When PAM is 0, 1 or 2, this event processing is immediately ended. When PAM is 3, i.e., the mode is the sequential tone assigning memory mode, processings of steps 121-129 are executed. The processings of steps 121-129 are ones similar to those of steps 74-79 of FIG. 4. In step 121, the value of the old time register OLDT is subtracted from the current value of the timer TIME and difference between the time when the preceding event occurred and the time when the current event has occurred, i.e., event time interval, is obtained and stored in the duration register D. Then, in the sequence data area (see the part c of FIG. 15) in the pad memory PDM corresponding to the pad number i, time interval data registered in the duration register D is stored as duration data D(i, P(i)) of an event order designated by the pointer P(i). If, for example, P(i) is 0, the time interval data of the duration register D is stored as the duration data D(i,0). Then, the pointer (i) is increased by 1 to designate next event order (i.e., current event order) (step 123).

In next step 124, the event code designating the type of the current setting operator event and event contents data representing the set state thereof are written as the event data E(i, P(i)) of the event order designated by the pointer P(i) in the sequence data area (see the part c of FIG. 15) in the pad memory PDM corresponding to the pad number i. In next step 125, whether the value of the pointer P(i) has reached the maximum value 19 or not is examined. If the result is NO, the routine proceeds to step 126 where the current value of the timer TIME is set in the old time register OLDT whereby the time when the current event has occurred is stored.

In this manner, in correspondence to the event (i.e., change in the set state) of the setting operator, duration data D(i, P(i)) concerning the preceding event order and the event data E(i, P(i)+1) are written.

When the value of the pointer P(i) has reached the maximum value 19 by the increment in step 123, step 125 becomes YES and processings of steps 127–129 which are entirely the same as the processings of steps 93–95 of FIG. 4 are executed and the pad assigning processing thereby is ended.

PROCESSING DURING REPRODUCTION OF THE PAD ASSIGNED TONES

Figure 18:
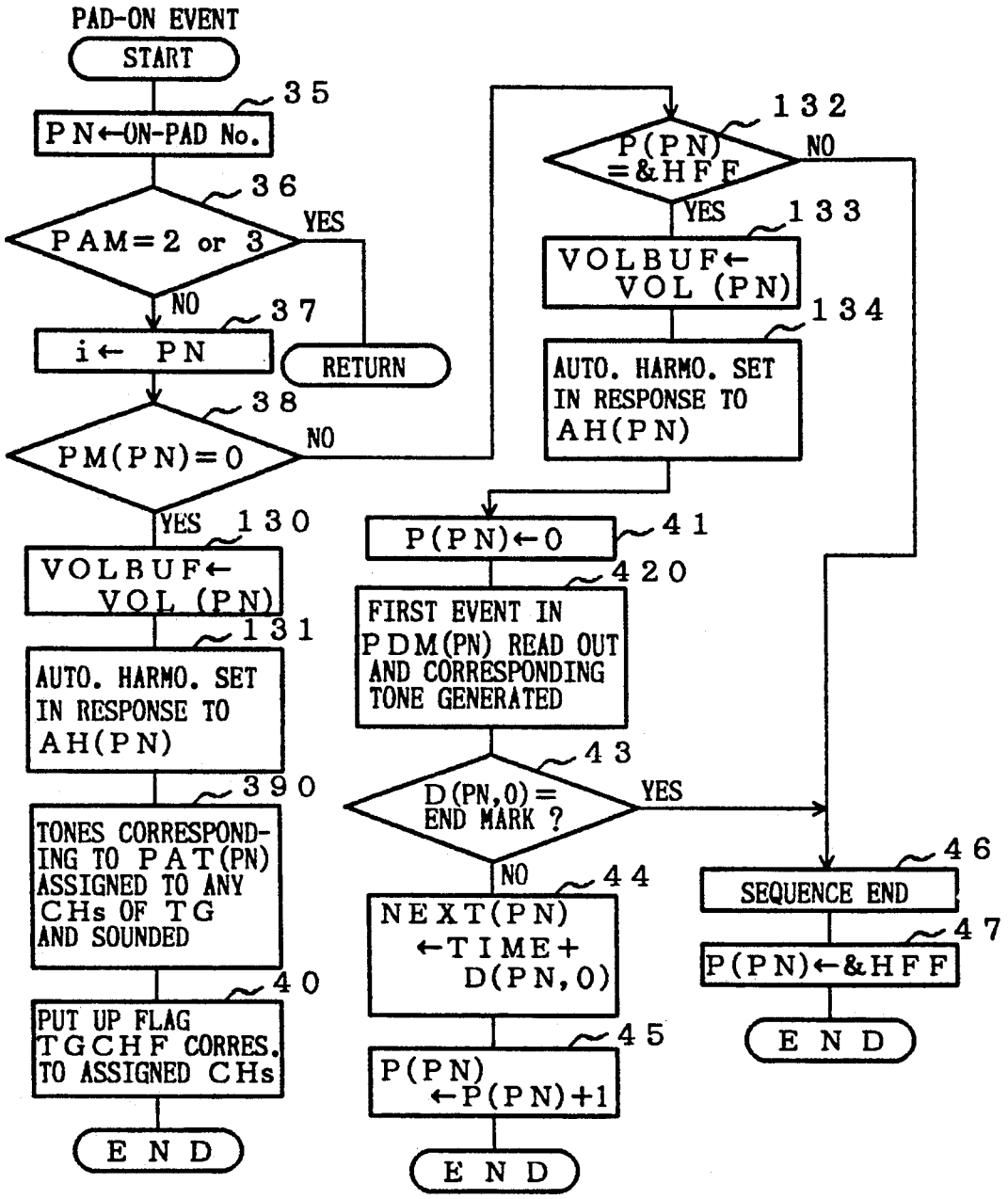
FIG. 18 is a flow chart showing an example of a pad-on event processing executed in the pad processing of FIG. 16.

In the second embodiment, as a processing associated with reproduction and generation of the pad assigned tones, the pad-on event processing of FIG. 6 is modified as shown in FIG. 18. In FIG. 18, steps 130–134 are added. Steps 39 ad 42 are changed to steps 390 and 420 in 12.

A processing during the simultaneous tone generation mode will be described first. Upon turning on of a desired pad, a pad-on event processing of FIG. 18 is started. Since the pad mode data of the turned on pad is PM(PN)=0 in the case of the simultaneous tone generation mode, step 38 becomes YES in FIG. 18 and the routine proceeds to steps 130, 131, 390 and 40. In step 130, tone volume setting data VOL(PN) is read from the pad memory PDM(PN) corresponding to the turned on pad and stored in the tone volume data buffer VOLBUF. In step 131, the automatic harmony data AH(PN) is read from the pad memory PDM(PN) corresponding to the turned on pad and, in response thereto, the on-off data and type data of the automatic harmony effect are set and stored in a predetermined buffer register. In step 390, in the same manner as step 39 of FIG. 6, the pad tone color data PTC(PN) and the pad assigned tone data PAT(PN) are read from the pad memory PDM and plural tones corresponding to the pad assigned tone data are assigned to different channels. The tone signal generation circuit 17 forms the tone signals of plural tones with a tone color corresponding to the pad tone color data and generate them. Step 390 is different from step 39 of FIG. 6 in that tone volumes of these plural tones are controlled by the tone volume setting data of the tone volume data buffer VOLBUF.

The processing for adding an automatic harmony tone is executed in the main routine (FIG. 16) in accordance with on-off data and type data of the automatic harmony effect stored in a predetermined buffer register in step 131.

A processing during the sequential tone generation mode will now be described. When the pad mode corresponding to the turned on pad is the sequential tone generation mode, PM(PN) is "1" and, therefore, in FIG. 18, step 38 becomes NO and the routine proceeds to step 132. In step 132, whether or not the value of the pointer P(PN) corresponding to the turned on pad is the predetermined end value &HFF. In the initial setting processing in the main routine of FIG. 16, the pointers of all pads are first set to &HFF and a pointer is set to &HFF also when the tone generation of the sequential tones has been completed. Therefore, the fact that the value of the pointer P(PN) is &HFF signifies that the sequential tones are not being generated. That is, when P(PN)=&HFF has been judged YES in step 132 of FIG. 18, it signifies that the current pad-on operation has been made for starting generation of the sequential tones. Therefore, when step 132 is YES, the routine proceeds to step 41 after execution of steps 133 and 134 and the processing for generating sequential tones is started.

Processings of steps 133 and 134 are the same as the processings of steps 130 and 131. Tone volume setting data VOL(PN) is read from the pad memory PDM(PN) corresponding to the turned on pad and is stored in the tone volume data buffer VOLBUF. The automatic harmony data AH(PN) is also read from the pad memory PDM(PN) and, in response thereto, the on-off data and type data of the automatic harmony effect are set and stored in a predetermined buffer register.

In step 41, the pointer P(PN) in the pad memory PDM(PN) of the turned on pad is set to 0 to designate the first event order. In next step 420, in the same manner as in step 42 of FIG. 6, the event data E(PN,0) and the duration data D(PN, 0) of the first event order designated by the pointer P(PN)=0 are read from the sequence data area (see the part c of FIG. 15) in the pad memory PDM(PN) and the tone generation processing for the tone corresponding to the key code designated by the event data E(PN,0) is executed. In this case, step 41 is different from step 42 of FIG. 6 in that the tone volume of this pad tone is controlled in accordance with the tone volume setting data of the tone volume buffer VOLBUF. Processings of subsequent steps 43–45 are the same as those of FIG. 6.

Figure 20:
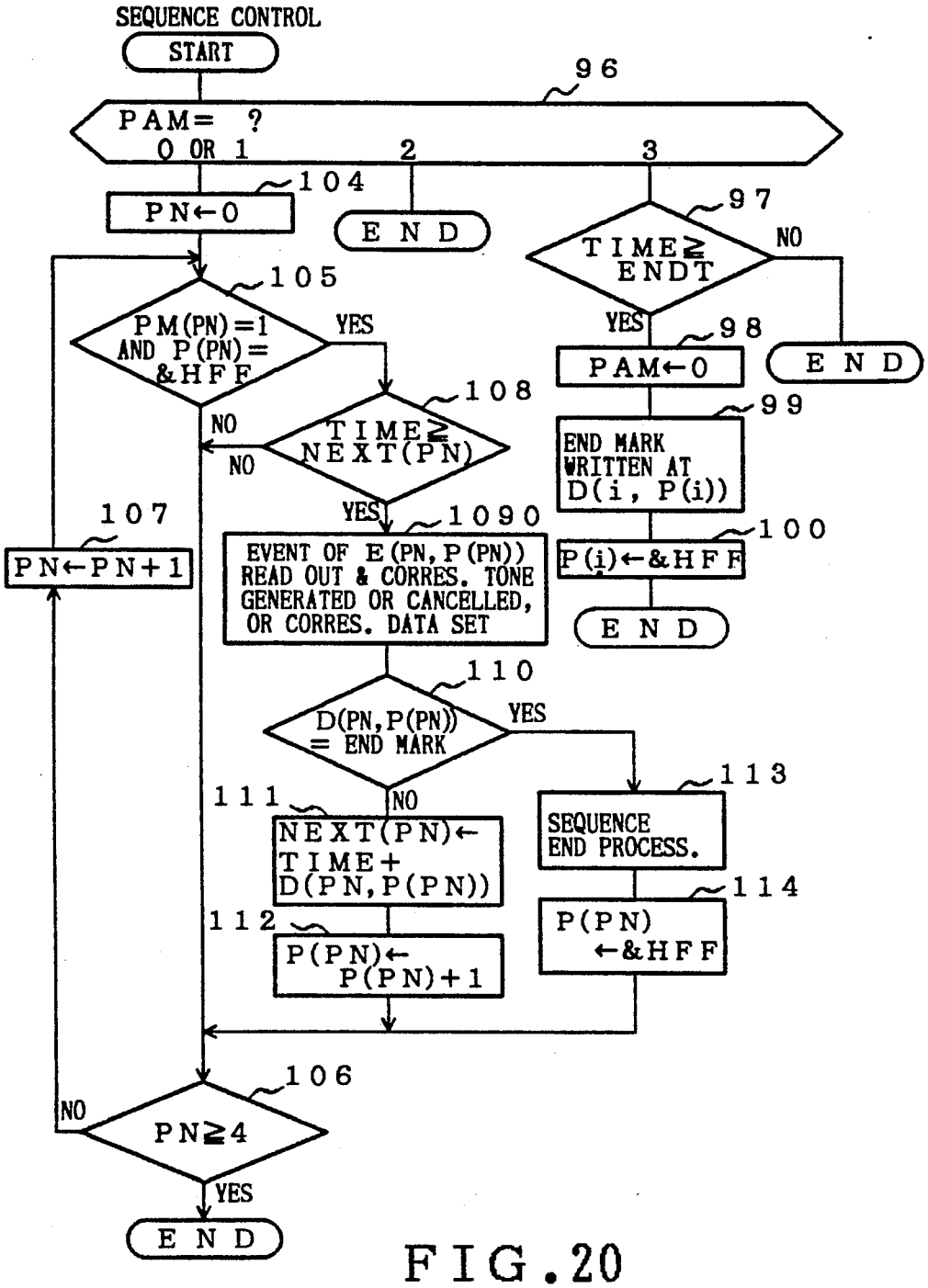
FIG. 20 is a flow chart showing an example of a sequence control processing executed in the main routine of FIG. 16.

In the foregoing manner, the processing for generating the sequence tone of the first event order assigned to the pad is executed. Processing for the second and subsequent events is executed in the sequential tone control processing of FIG. 20. The processing of FIG. 20 is almost the same as the processing of FIG. 11 except that step 109 of FIG. 11 has been partially changed. The changed part is designated as step 1090 in FIG. 20.

As described above, when the current value of the timer TIME has reached next event time NEXT(PN), step 108 becomes YES and the routine proceeds to step 1090. In step 1090, the current value of the pointer P(PN) of the pad memory PDM(PN) designated by PN is read out. The event data E(PN,P(PN)) and duration data D(PN,P(PN)) of the event order designated by the pointer P(PN) are read from the sequence data area (see the part c of FIG. 15) in the pad memory PDM(PN) and generation or cancellation of the tone corresponding to the key code designated by the event data E(PN,P(PN)) or setting of a tone color, tone volume and effect is executed. When the event code of the event data E(PN,P(PN)) designates depression of a key, the tone generation processing is executed whereas when the event code designates release of a key, the tone cancellation processing is executed. In executing the tone generation processing, tone volume of the generated tone is controlled in accordance with the tone volume setting data of the tone volume data buffer VOLBUF. When the event code of the event data E(PN,P(PN)) designates an event of a setting operator, contents of set data are changed in accordance with event contents data corresponding to the event code. When, for example, the event code is the tone volume event, tone volume setting data stored as the event contents data is stored in the tone volume data buffer VLBUF. When the event code is the automatic harmony event, the automatic harmony data (i.e., on-off data or type data of the automatic harmony effect) which is stored as the event contents data is set and stored in a predetermined buffer register. Processings of subsequent steps 110–114 are the same as those of FIG. 11.

Thus, the sequential tones assigned to the pad are sequentially generated and, as time elapses, set states of tone color, tone volume and automatic harmony effect which have been assigned and stored in the pad in correspondence to lapse of time are reproduced and the tone color and tone volume of the pad tone are controlled in accordance with the reproduced tone color and tone volume setting data and the automatic harmony tone corresponding to the reproduced automatic harmony effect set state is added.

In the example of FIG. 20, an arrangement is made so that, when the pad is depressed again during generation of sequential tones corresponding to a desired pad, generation of the sequential tones is automatically stopped. In other words, since the pointer P(PN) assumes a value other than &HFF during generation of the sequential tones, redepression of the same pad is judged to be NO in step 132 of FIG. 20. The routine therefore proceeds to steps 46 and 47 where a processing for ending generation of the sequential tones is executed and the pointer P(PN) is set to &HFF.

MODIFIED EXAMPLES

In the plural tone assigning mode and sequential tone assigning mode, details of the assigning processing are not limited to the above described embodiment but a suitable modification can be made in either mode.

Assigning processing of plural tones or sequential tones to a pad and other various-processings are not limited to the software processing executed by the microcomputer as described above but these processings may be made by an exclusive hardware circuit.

A performance operator to which plural tones can be assigned is not limited to the pad used in the above described embodiment (an operator having an elastic operation surface) but any other operator may be used. The sensor of the performance operator may be so constructed that it detects not only on-off of an operation but also operation touch and a generated tone may be controlled in response to this touch.

As means for selectively designating tones to be assigned, a keyboard or tone color designation switch is used in the above described embodiment. This means is not limited to these but other suitable data input means may be utilized for this purpose.

In the plural tone assigning mode, one or more desired tones are simultaneously assigned and stored in the above described embodiment. The invention is not limited to this but desired tones may be added or cancelled one by one.

In the sequential tone assigning mode, time data (duration data) between respective events is set in accordance with operation of the keyboard in the above described embodiment. The invention-however is not limited to this but data input-may be made by other suitable data input means. The maximum number of sequential tones and duration of phrase time are not limited to those of the above described embodiment but they may be suitably modified.

The technique for storing set information by setting operators for tone volume and effects etc. in correspondence to a performance operator such as a pad is not limited to one combined with the technique for assigning plural tones to a performance operator such as a pad as described in the above embodiment but is applicable also to the case where only one tone is assigned to a performance operator such as a pad.

In the above described embodiment, the assignment deciding processing according to the off operation of a performance operator is executed in the plural tone assigning mode. The invention is not limited to this but the assigning deciding processing according to the off operation can be executed also in the case of assigning only one tone to the performance operator.

The number of the performance operators used is not limited to plural but only one operator may be used.

Details of the assigning processing to the pad are not limited to the processing in the above described embodiment but may be suitably modified.

As a performance operator to which a desired tone can be assigned is not limited to the pads shown in the above described embodiment but any other operator may be used. Further, the sensor of the performance operator may be so constructed that it detects not only on-off of an operation but also operation touch and a generated tone may be controlled in response to this touch.

As means for designating a desired tone, the keyboard or tone color designation switch is used in the above described embodiment. The invention is not limited to this but other suitable data input means may be employed.

As described in the foregoing, according to the embodiment, desired plural tones can be assigned for one performance operator and this assignment can be changed as desired and, accordingly, the desired plural tones can be generated in a simple manner only by a single operation of the performance operator.

By the provision of a plurality of the performance operators and the mode selection means capable of selecting one of the first mode in which plural tones can be generated simultaneously by operation of one performance operator and the second mode in which the plural tones can be generated sequentially by operation of one performance operator, the simultaneous performance of plural tones such as a chord and the sequential performance of plural tones can be made in a simple manner by a single operation of the performance operator. By coexistence of performances of these two different modes, the performance ability of the electronic musical instrument is greatly improved.

In assigning a desired tone to a performance operator, various setting operators such as tone volume, effects etc. are set to desired set states and these set information are also stored. In response to subsequent operation of a performance operator, a tone corresponding to the tone assigned to this performance operator is generated and the stored setting information is read out to execute a tone control or effect imparting control in response to this set information. When, therefore, the assigned tone is reproduced by operation of the performance operator, the desired set states of the setting operators can be reproduced at once so that a control of a reproduced tone and various effects imparted to the reproduced tone is facilitated and tones can be reproduced with more accuracy whereby the performance ability is improved. Further, by providing a plurality of the performance operators, the performance ability is further improved since a different set state can be assigned for each of the performance operators. When, for example, the plural performance operators are simultaneously operated to generate the assigned tones, the tone control can be made and effects can be imparted in different set states for each of the tones corresponding to the respective performance operators, so that an entirely novel performance effect can be produced.

Further, according to the invention, desired plural tones are assigned to the Performance operator in a desired tone generation order and, in correspondence to this assignment, information representing a set state of at least one of the setting operators of the setting operator means is stored together with timewise change of the set state. When this performance operator is operated, the plural tones which have been assigned to the performance operator are sequentially generated and the change of the set state is timewise reproduced on the basis of the storage in the memory means to perform a tone control or an effect imparting control in accordance with the reproduced set state. Performance of sequential tones can thereby be made in a simple manner and, moreover, set states for various tone controls and effect imparting controls can be automatically changed sequentially as time elapses, so that an entirely novel performance effect can be obtained and the operation is facilitated.

Further, according to the invention, since the assignment is determined definitely when the performance operator has turned from an on state to an off state, change of the designated tone can-be made freely by the assigned tone designation means even after turning on of the performance operator if it is before turning off of the performance operator. When, therefore, a wrong tone has been designated for assignment, designation of the assigned tone has only to be made again and the performance operator need not be turned on again. Thus, the assignment operation is facilitated.

When the performance operator has been turned on, the contents of assigned tone have not been changed yet and, accordingly, the already assigned tone can be generated in response to the turning on of the performance operator. The player can therefore listen to this already assigned tone and confirm it and thereafter designate a desired tone to be assigned which is newly assigned when the performance operator is subsequently turned off. Therefore, the operation for generating the already assigned tone and the operation for assigning a new tone can be made at once by a single on-off operation of the performance operator whereby the operations are facilitated.

What is claimed is:

1. An electronic musical instrument comprising:

a pad type performance operator;

assigning means for assigning to the performance operator plural tones which are to be generated sequentially, said assigning means including memory means for storing tone information indicative of the individual tones assigned to the performance operator and timing information designating respective tone generation timings of said individual tones; and tone signal generation means for sequentially generating, when said performance operator is operated, tone signals corresponding to the plural tones assigned to said performance operator at respective timings designated by said timing information.

2. An electronic musical instrument as defined in claim 1, wherein said assigning means further includes selection means for selecting said tone information of the individual tones to be assigned to the performance operator.

3. A electronic musical instrument as defined in claim 2, wherein said tone information includes tone pitch information.

4. An electronic musical instrument as defined in claim 2, wherein said tone information includes tone color information.

5. An electronic musical instrument as defined in claim 1, wherein said pad type performance operator comprises a plurality of performance operators, the number of said performance operators being smaller than the number of keys provided on a keyboard for designating tone pitches of tones to be generated and wherein said assigning means selects tone information corresponding to a pitch of a depressed key on the keyboard and assigns the selected tone information to one of said performance operators.

6. An electronic musical instrument comprising:

a performance operator;

mode selection means for selecting one of a first mode in which plural tones are generated simultaneously in response to an operation of said performance operator and a second mode in which plural tones are generated sequentially in response to the operation of said performance operator;

assigning means for assigning desired plural tones to said performance operator in accordance with the mode which is selected by said mode selection means, in such a manner that said assigning means, when the second mode has been selected, assigns to the performance operator plural tones which are to be generated sequentially, said assigning means including memory means for storing tone information indicative of the individual tones assigned to the performance operator and timing information designating respective tone generation timings of said individual tones to be generated sequentially; and tone signal generation means for generating tone signals corresponding to the desired plural tones which are assigned to said performance operator in accordance with the selected mode when said performance operator is operated, to sound tones corresponding to the generated tone signals upon operation of said performance operator, said tone signal generation means, when the second mode has been selected, sequentially generating tone signals corresponding to the plural tones assigned to said performance operator at respective timings designated by said timing information.

7. An electronic musical instrument as defined in claim 6, wherein a plurality of the performance operators are provided and said assigning means is capable of changing an assignment of the desired plural tones in any of said modes independently for each of said performance operators whereby assignments in different modes among said performance operators can coexist.

8. An electronic musical instrument as defined in claim 6, wherein said performance operator comprises a plurality of performance operators, the number of said performance operators being smaller than the number of keys provided on a keyboard for designating tone pitches of tones to be generated, and wherein said assigning means selects tone information corresponding to a pitch of a depressed key on the keyboard and assigns the selected tone information to one of said performance operators.

9. An electronic musical instruments as defined in claim 8, wherein said performance operators comprise pad type operators.

10. An electronic musical instrument comprising:

a performance operator;

assigning means for assigning to the performance operator plural tones which are to be generated sequentially, said assigning means including memory means for storing tone information indicative of the individual tones assigned to the performance operator and timing information designating respective tone generation timings of said individual tones;

setting operator means including a setting operator for setting data for controlling a tone;

memory means for storing set data set by said setting operator of said setting operator means in correspondence to a tone assigned to said performance operator; and tone signal generation means for sequentially generating, when said performance operator is operated, tone signals corresponding to the plural tones assigned to said performance operator at respective timings designated by said timing information, to sound tones corresponding to the generated tone signals upon operation of said performance operator, said tone signal generation means also reading out the set data stored in said memory means so as to perform a control corresponding to the set data when said performance operator is operated.

11. An electronic musical instrument as defined in claim 10, wherein said setting operator means has an operator for selecting an automatic harmony effect which automatically imparts a tone having a predetermined note interval to a tone being sounded and information representing the set state of said operator for selecting the automatic harmony effect is stored in said memory means.

12. An electronic musical instrument as defined in claim 10, wherein there are provided a plurality of said performance operators and said assigning means assigns a desired tone independently for each of said performance operators, said memory means store information of a set state of at least one of said operators of said setting operator means for each of said performance operators, and said tone signal generation means generates a tone signal corresponding to the tone which is assigned to an operated one of said performance operators and reads out the set information stored in said memory means in correspondence to the operated performance operator to perform a control corresponding to the set information.

13. An electronic musical instrument comprising:

a performance operator;

assigning means for assigning a desired tone to the performance operator;

setting operator means including a setting operator for setting data for controlling a tone;

memory means for storing set data set by said setting operator of said setting operator means in correspondence to a tone assigned to said performance operator, said memory means storing information representing a set state of said operator of said setting operator means together with a timewise change of said set state in accordance with assignment of the tone to said performance operator by said assigning means; and tone signal generation means for generating a tone signal of the tone corresponding to said performance operator and reading out the set data stored in said memory means as to perform a control corresponding to the set data when said performance operator is operated, a tone corresponding to the generated tone signal being sounded upon operation of said performance operator.

14. An electronic musical instrument comprising:

a performance operator;

setting operator means including a setting operator for setting data for controlling a tone;

assigning means for assigning desired plural tones, one by one, to said performance operator in a desired tone generation order;

memory means for storing information representing a set state of said setting operator of said setting operator means together with a timewise change of the set state in correspondence to assignment of a tone to said performance operator by said assigning means; and tone signal generation means for sequentially generating tone signals corresponding to the plural tones which have been assigned to said performance operator and reproducing the change in the set state timewise in accordance with stored information in said memory means to perform a control of the tone signals corresponding to reproduced set state when said performance operator is operated, tones corresponding to the generated tone signals being sounded upon operation of the performance operator.

15. An electronic musical instrument comprising:

a performance operator;

assigned tone designation means for designating a tone to be assigned to said performance operator;

assignment control means for performing a control for assigning the tone which is designated by said assigned tone designation means to said performance operator when said performance operator is turned from an on-state to an off-state; and tone signal generation means for generating a tone signal corresponding to the tone which is assigned to said performance operator when said performance operator is turned on.

16. An electronic musical instrument as defined in claim 15, wherein said tone signal generation means generates a tone signal corresponding to the designated tone when the tone is designated by said assigned tone designation means.

17. An electronic musical instrument as defined in claim 15, wherein said tone signal generation means comprises memory means for storing information of the tone which is assigned to said performance operator and said tone signal generation means generates a tone signal of the tone which is assigned to said performance operator in accordance with the information of the tone stored in said memory means.

* * * * *